US006397027B2

(12) United States Patent
Katakabe et al.

(10) Patent No.: US 6,397,027 B2
(45) Date of Patent: May 28, 2002

(54) IMAGE FORMING APPARATUS HAVING A PLURALITY OF IMAGE FORMING UNITS WITH PIVOTABLE SUBUNITS

(75) Inventors: Noboru Katakabe, Kyoto; Keizou Takeuchi; Shigemitsu Tani, both of Osaka, all of (JP)

(73) Assignees: Matsushita Electric Industrial Co., Ltd., Osaka; Matsushita Graphic Communication Systems, Inc., Tokyo, both of (JP)

( * ) Notice: Subject to any disclaimer, the term of this patent is extended or adjusted under 35 U.S.C. 154(b) by 0 days.

(21) Appl. No.: 09/933,034

(22) Filed: Aug. 20, 2001

Related U.S. Application Data

(62) Division of application No. 09/599,595, filed on Jun. 22, 2000.

(30) Foreign Application Priority Data

Jun. 28, 1999 (JP) ..... 11-181996
Jun. 30, 1999 (JP) ..... 11-185238

(51) Int. Cl.[7] ..... G03G 21/18
(52) U.S. Cl. ..... 399/113
(58) Field of Search ..... 399/111, 113, 399/227, 299, 306

(56) References Cited

U.S. PATENT DOCUMENTS

| | | | | |
|---|---|---|---|---|
| 4,583,832 A | | 4/1986 | Kasamura et al. | |
| 4,591,258 A | | 5/1986 | Nishino et al. | |
| 4,620,783 A | | 11/1986 | Tanaka et al. | |
| 4,646,679 A | | 3/1987 | Ohno et al. | |
| 5,204,713 A | | 4/1993 | Yamamura | |
| 5,229,821 A | | 7/1993 | Fujii | |
| 5,587,783 A | | 12/1996 | Nakamura et al. | |
| 5,610,701 A | * | 3/1997 | Terada et al. | 399/298 |
| 5,617,188 A | | 4/1997 | Inomata | |
| 5,649,264 A | | 7/1997 | Domon et al. | |
| 5,745,824 A | * | 4/1998 | Yashiro | 399/113 |
| 5,809,380 A | * | 9/1998 | Katakabe et al. | 399/227 |
| 5,812,910 A | | 9/1998 | Kim | |
| 5,819,139 A | | 10/1998 | Harlan et al. | |
| 5,867,754 A | | 2/1999 | Endo et al. | |
| 5,899,597 A | | 5/1999 | Shinohara et al. | |
| 5,943,528 A | * | 8/1999 | Akutsu et al. | 399/110 |
| 5,956,552 A | * | 9/1999 | Katakabe et al. | 399/298 |
| 6,016,408 A | | 1/2000 | Hashimoto et al. | |
| 6,151,459 A | | 11/2000 | Hashimoto et al. | |
| 6,157,799 A | * | 12/2000 | Asakura et al. | 399/167 |
| 6,185,396 B1 | * | 2/2001 | Aizawa et al. | 399/121 |

FOREIGN PATENT DOCUMENTS

| | | | |
|---|---|---|---|
| EP | 570 993 | | 11/1993 |
| EP | 878 742 | | 11/1998 |
| JP | 59-58444 | | 4/1984 |
| JP | 01-244472 A | | 9/1989 |
| JP | 1-293369 | | 11/1989 |
| JP | 2-11155 | | 3/1990 |
| JP | 2-158757 | | 6/1990 |
| JP | 3-132768 | | 6/1991 |
| JP | 5-61330 | | 3/1993 |
| JP | 05-232752 | * | 9/1993 |
| JP | 6-317986 | | 11/1994 |
| JP | 10-190246 | | 7/1998 |
| JP | 2000-221767 | | 8/2000 |

* cited by examiner

*Primary Examiner*—Robert Beatty
(74) *Attorney, Agent, or Firm*—Merchant & Gould PC

(57) ABSTRACT

An image forming apparatus uses a plurality of image forming units which are rotatable arranged in a vertical plane. The image forming units are divided into a photosensitive member unit for supporting a photosensitive member and a developing unit for supporting a developing roller and wherein the units are rockably supported about a rocking center axis. A point of application of a drive force for transmitting a drive force to the developing roller is located substantially on the rocking center axis.

11 Claims, 14 Drawing Sheets

IMAGE FORMING APPARATUS HAVING A PLURALITY OF IMAGE FORMING UNITS WITH PIVOTABLE SUBUNITS

This application is a divisional of application Ser. No. 09/599,595, filed Jun. 22, 2000, which application(s) are incorporated herein by reference.

FIELD OF THE INVENTION

The present invention relates to an image forming apparatus that is applicable, for example, as a printer, a copying machine or a facsimile, and to an image forming unit used therefor.

BACKGROUND OF THE INVENTION

In a conventional image forming unit of an image forming apparatus, units having a handle for carrying it easily, has been much developed. For example, JP 2-11155B discloses an image forming unit shown in FIG. 14, in which a handle 300 is formed as one unit with an image forming unit main body 301.

However, in the image forming unit having this conventional handle, since the handle is formed as one unit with the image forming unit main body, it is necessary to have a large space for containing the image forming unit in the image forming apparatus. Consequently, it is not possible to downsize the image forming apparatus.

Furthermore, in this kind of image forming apparatus, it is necessary to detect the amount of toner that remains in the image forming unit. As a technology for detecting the amount of remaining toner, for example, the technology disclosed in JP 6-317986A is well known. This publication discloses an image forming apparatus including a light transmission window on the developing device and an aperture on a developing cartridge so that a developing cartridge has a light path passing through a toner containing portion of the developing device on a line connecting a rotary unit (which is a holding member of a switching mechanism) and an outer position sandwiching the developing cartridge between the rotary unit and the outside position when a developing cartridge is positioned at the developing position. In this apparatus, the amount of toner remaining in the toner containing portion of the developing cartridge positioned at the developing position is detected by a light transmission method at the position between the rotary unit and the outer position.

Furthermore, in the image forming apparatus having this conventional means for detecting the amount of remaining toner, since the amount of remaining toner in the toner containing portion is detected by the light transmission method at a position outside of the position sandwiching the developing cartridge between the rotary unit and the outside position, the light path for detection becomes longer. As a result, the optical sensor becomes specific, which may deteriorate the accuracy.

Furthermore, as a conventional color image forming apparatus, in particular, an image forming unit used therefor, for example, one disclosed in JP 6-93141B is well known.

The following is a description of the conventional image forming unit disclosed in this publication, with reference to FIG. 15. In FIG. 15, numeral 302 denotes a photosensitive member, 303 denotes a developing roller, and 304 denotes a charger. Numeral 305 denotes a photosensitive member unit supporting the photosensitive member 302 and the charger 304 and formed into one unit with a cleaner case, and 306 denotes a developing unit supporting a developing roller and formed into one unit with a toner case. The developing unit 306 is linked rotatably to the photosensitive member unit 305 by a supporting axis 307. Numeral 308 denotes a compression spring, which is provided at the opposite side to the photosensitive member 302 while sandwiching the supporting axis 307 between the developing unit 306 and the photosensitive member unit 305. Thereby, the photosensitive member 302 and the developing roller 303 are pressed to each other and in contact with each other. The developing roller 303 is driven to be rotated by using a rotation force of the photosensitive member 302. A gear fixed to the photosensitive member 302 and a gear fixed to the developing roller 303 (both gears are not shown) are coupled with each other and driven to be rotated in the arrow directions, respectively.

In general, when such a image forming unit is attached to an electro-photographic apparatus main body, the axis center position of the photosensitive member 302 and a part of the photosensitive member unit 305 are supported firmly by the apparatus main body, and the photosensitive member 302 is driven to be rotated. Thus, images are formed.

In the formation of a color image, it is necessary to reduce unnecessary disturbance to the photosensitive member so as to improve the rotation accuracy of the photosensitive member and to bring the developing roller into light and uniform contact with the photosensitive member, thus to form a image with less unevenness in color or thickness of the image.

However, in the above-mentioned conventional image forming unit, the unevenness in rotation is transferred easily to the photosensitive member. Furthermore, the rotation driving force applying to the developing roller works as a pressing power with respect to the photosensitive member. As a result, the contact pressure of both rollers is uneven, and thus the unevenness in colors or thickness of the image tends to occur.

SUMMARY OF THE INVENTION

It is an object of the present invention to provide an image forming unit having a handle and a compact size with a smaller containing space needed and an image forming apparatus using this image forming unit. Furthermore, it is another object of the present invention to provide an image forming unit capable of detecting the amount of toner remaining in a toner containing portion without deteriorating the detection accuracy and having a simple structure; and an image forming apparatus using this image forming unit. Furthermore, it is a further object of the present invention to provide an image forming unit and an image forming apparatus using this image forming unit, which do not tend to provide disturbance to the rotation of the photosensitive member; keep the contact pressure between the developing roller and the photosensitive member small and uniform; and are capable of forming a high quality image without unevenness in colors or thickness of the image.

In order to attain the above-mentioned object, a first configuration of an image forming unit according to the present invention includes an image forming unit main body having an image forming means, and a handle provided at the image forming unit main body so that it is capable of taking a holdable posture in which a user can hold the handle and a non-holdable posture in which a user cannot hold the handle, and is urged toward the non-holdable posture constantly by its elasticity. According to the first configuration of the image forming unit, it is possible to attain an image forming unit equipped with a handle and having a compact size with a smaller containing space required as compared with conventional units.

It is preferable in the first configuration of the image forming unit according to the present invention that the handle is made of an elastic plate having elongated holes at both ends thereof, is attached to an attachment surface of the image forming unit main body through the elongated hole by an anchoring member, and is capable of taking a non-holdable posture in which the handle is in contact with or close to the attachment surface and a holdable posture in which at least one part of the handle is separated from the attachment surface. With such a preferred configuration, it is possible to realize an image forming unit having a handle with a simple structure and inexpensively.

Furthermore, it is preferable in the first configuration of the image forming unit according to the present invention that the image forming unit is used for the image forming apparatus in which a plurality of image forming units are arranged rotatably in a vertical plane, and the plurality of image forming units are shifted sequentially to the image forming position so as to form images, wherein the handle is provided on the outer periphery of the rotation surface of the image forming unit main body. With such a preferred configuration, it is possible to attach/detach the image forming unit to/from the image forming apparatus easily. In this case, it is further preferable that the handle is urged toward the non-holdable posture by an elasticity that is stronger than a self-weight by which the handle is urged toward the holdable posture. With such a preferred configuration, it is possible to prevent the handle from taking the holdable posture when it comes to the lowermost place. In this case, it is still further preferable that the image forming unit includes a photosensitive member and a developing device and that the photosensitive member is exposed to the outer periphery of the rotation surface of the image forming unit main body. With such a preferred configuration, it is possible to transfer a toner image on the photosensitive member to the recording paper, easily. In this case, it is further preferable that the handle in its non-holdable posture is present inside the rotation track surface of the photosensitive member, and the handle in its holdable posture is present outside the rotation track surface of the photosensitive member. With such a preferred configuration, when the image forming unit is rotated in the image forming apparatus, the handle avoids contact with the transfer means without the need for additional complex operation.

It is further preferable that the image forming unit of the first configuration according to the present invention includes a photosensitive member unit that supports the photosensitive member and a developing unit that supports the developing device and that the handle is provided at the side of the developing unit. With such a preferred configuration, since the handle is provided at the side of the developing unit containing heavier parts such as a developing device, etc., it is possible to balance the image forming unit when it is suspended by holding the handle. Furthermore, by providing the handle at the side of the developing unit, it is possible to secure a sufficient space for placing the handle.

According to the first configuration of the image forming apparatus according to the present invention, the image forming apparatus including a unit-rotating member that supports a plurality of image forming units in a vertical plane rotatably, and forming images by shifting the plurality of image forming units sequentially to the image forming position, wherein the image forming unit includes an image forming unit main body having an image forming means, and a handle provided at the image forming unit main body so that it is capable of taking a holdable posture in which a user can hold the handle and a non-holdable posture in which a user cannot hold the handle, and is urged toward the non-holdable posture constantly by its elasticity.

It is preferable that the first configuration of the image forming apparatus according to the present invention includes an opening/closing door for allowing attaching/detaching of the image forming unit to/from the upper part of the unit-rotating member, wherein the opening/closing door is capable of pressing, in its holdable posture, the handle of the image forming unit installed to the unit-rotating member. With such a preferred configuration, even if a user forgets to put the handle in the non-holdable posture, when the image forming unit is replaced with a new unit, by only closing the opening/closing door, the handle can be put in the non-holdable posture. Furthermore, in this case, it is preferable that the opening/closing door is provided with a protruding portion capable of being brought into contact with the handle of the image forming unit in its holdable posture.

Furthermore, according to the second configuration of the image forming apparatus of the present invention, the image forming apparatus includes a unit-rotating member that supports a plurality of image forming units in a vertical plane rotatably, and forming images by shifting the plurality of image forming units sequentially to the image forming position, wherein the image forming unit comprises an image forming unit main body, a photosensitive member exposed to the outer periphery of the rotation surface of the image forming unit main body, a handle provided at the image forming unit main body, and the handle of the image forming unit at the position where the image forming unit is replaced with a new unit in the unit-rotating member, is arranged farther from a front side of the image forming apparatus than the photosensitive member. According to the second configuration of the image forming apparatus, when the image forming unit is replaced with a new unit, it is possible reliably to prevent the operator's finger from touching the exposed photosensitive member.

Furthermore, according to the third configuration of the image forming apparatus of the preset invention, the image forming apparatus includes a unit-rotating member that supports a plurality of image forming units in a vertical plane rotatably, and forming images by shifting the plurality of image forming units sequentially to the image forming position, wherein the image forming unit comprises a photosensitive member unit that supports the photosensitive member, a developing unit that supports the developing device, and a handle; the photosensitive member is exposed to the outer periphery of the rotation surface of a photosensitive member unit main body; in the image forming unit at the position where the image forming unit is replaced with a new unit in the unit-rotating member, the photosensitive member unit and the developing unit are arranged in this order from the front side of the image forming apparatus; and the handle is provided at the side of the developing unit. According to the third configuration of the image forming apparatus, it is possible to locate the handle of the image forming unit in the unit-rotating member at a replacement position where the image forming unit is replaced with a new unit farther from the front side of the image forming apparatus than the photosensitive member. As a result, when the image forming unit is replaced with a new unit, it is possible reliably to prevent the operator's finger from touching the exposed photosensitive member.

Furthermore, it is preferable in the second or third configuration of the image forming apparatus according to the present invention that the replacement of the image forming unit from the rear side of the image forming apparatus is suppressed. With such a preferred configuration, it is possible reliably to prevent the operator's finger from touching the photosensitive member. In this case, it is still further preferable that the image forming apparatus includes an opening/closing door for attaching/detaching the image forming unit to/from the upper part of the unit-rotating member, thereby regulating the replacement of the image forming unit from the rear side of the image forming apparatus.

According to the second configuration of the image forming unit of the present invention, an image forming unit is used for the image forming apparatus in which a plurality of image forming units are arranged rotatably in a vertical plane, and the plurality of image forming units are shifted sequentially to the image forming position, wherein a translucent detection window for detecting the amount of remaining toner is provided on the periphery of the rotation surface of the image forming unit main body that communicates to a toner hopper. According to the second configuration of the image forming unit, a translucent detection window for detecting the remaining toner is provided on the outer periphery of the rotation surface of the image forming unit main body that communicates to the toner hopper. Therefore, by arranging a detection member such as a light emitting element, a light receiving element, or the like, in the vicinity of the detection window, it is possible to detect the amount of remaining toner, thus to shorten the light path for detection. As a result, it is possible to enhance the accuracy in detecting the amount of remaining toner. Furthermore, the translucent detection window is exposed to the outside of the image forming unit main body, it is possible to check visibly the amount of remaining toner after taking out the image forming unit from the image forming apparatus main body.

Furthermore, it is preferable in the second configuration of the image forming unit according to the present invention that the detection window is located at the corner on the periphery of the rotation surface of the image forming unit main body. With such a preferred configuration, since the detection window is located at the bottom surface of the toner hopper, it is possible to detect only a small amount of toner easily.

Furthermore, it is preferable in the second configuration of the image forming unit according to the present invention that the detection window is provided in a cavity formed in the toner hopper, and has a pair of opposed side faces, further comprising reflection planes refracting light for detecting the amount of remaining toner, the reflection planes being provided in the vicinity of the pair of side faces. With such a preferred configuration, it is not necessary to arrange a detection member such as a light emitting element, a light-receiving element, etc., and it is possible to make the light path for detection relatively short.

Furthermore, it is preferable that the second configuration of the image forming unit according to the present invention includes a cleaning member for cleaning the detection window. With such a preferred configuration, it is possible to enhance the accuracy in detecting the amount of remaining toner by appropriately cleaning the detection window.

According to the fourth configuration of the image forming apparatus according to present invention, an image forming apparatus includes a unit rotating member that supports a plurality of image forming units in a vertical plane rotatably, and forming images by shifting the plurality of image forming units sequentially to the image forming position; wherein a translucent detection window for detecting the amount of remaining toner is provided on the periphery of the rotation surface of the image forming unit main body that communicates with a toner hopper.

It is preferable in the fourth configuration of the image forming apparatus according to the present invention that the detection window is located at the corner on the periphery of the rotation surface of the image forming unit main body.

Furthermore, it is preferable in the fourth configuration of the image forming apparatus according to the present invention that the detection window is provided in a cavity formed in the toner hopper, and has a pair of opposed side faces, further comprising reflection planes refracting light for detecting the amount of remaining toner, the reflection planes being provided in the vicinity of the pair of side faces. Furthermore, in this case, it is preferable that a detection means that emits/receives light for detecting the amount of remaining toner is provided facing the periphery of the rotation surface of the image forming unit main body.

Furthermore, it is preferable in the fourth configuration of the image forming apparatus according to the present invention that the detection of the amount of remaining toner is performed at a different position from the image forming position. With such a preferred configuration, it is possible to arrange the detection means that emits/receives light for detection of the amount of remaining toner. Furthermore, in this case, it is preferable that the detection of the amount of remaining toner is performed when the detection window is located at a lower place than the horizontal line including the rotation center of the unit-rotating member. With such a preferred configuration, it is possible to detect only a small amount toner. Furthermore, in this case, it is preferable that the detection of the amount of remaining toner is performed when the image forming unit is located at the opposite side to the image forming position. Furthermore, in this case, it is preferable that a cleaning member for cleaning the detection window is provided, and the cleaning of the detection window is performed only at the image forming position. With such a preferred configuration, it is not necessary to provide a mechanism for driving the cleaning member at several positions, thus simplifying the structure of the image forming apparatus.

Furthermore, it is preferable in the second configuration of the image forming apparatus according to the present invention that the amount of remaining toner of the image forming unit for one color is detected several times while the unit-rotating member rotates several times thus to obtain the detected results, and the amount of the remaining toner is determined based on the detected results. With such a preferred configuration, it is possible to reduce the detection error and to detect the amount of the remaining toner precisely.

Furthermore, according to the third configuration of the image forming unit according to the present invention, an image forming unit includes a photosensitive member unit having a photosensitive member on the surface of which a electrostatic latent image is formed, and a developing unit which has a developing agent, a developing roller supporting the developing agent at the developing region, and a driving transmitting means for rotating the developing roller, and which develops the electrostatic latent image to be a manifest image, wherein the developing unit is supported by the photosensitive member unit rockably, the point of application, which transmits the rotation force to the developing unit, is provided in the vicinity of the rocking center axis of the photosensitive member unit and the developing unit. With the third configuration of the image forming unit, the developing unit is driven to be rotated by the force that transmits a rotation force to the developing unit, and the developing roller is not pressed onto the photosensitive member and the pressing power that is set when the developing roller is not rotated can be maintained. Therefore, it is possible to bring the developing roller into contact with the photosensitive member constantly and stably.

Furthermore, it is preferable in the third configuration of the image forming unit according to the present invention that a driving force for rotating the developing roller is applied from the outside of the image forming unit. With such a preferred configuration, the photosensitive member is not subjected to a load fluctuation as the photosensitive member drives the developing roller. Moreover, since the contact pressure of the developing roller to the photosensitive member can be set to be small, the photosensitive member is not susceptible to the disturbance from the developing roller, whereby the stable rotation can be secured. Furthermore, in this case, it is preferable that the developing roller is in contact with the photosensitive member, thereby developing an electrostatic latent image to be a manifest image. Furthermore, in this case, it is preferable that the developing unit is supported by the photosensitive member unit rockably at the driving side of the developing unit, and the relative position between the photosensitive member of the photosensitive member unit and the developing roller is determined by a sliding guide provided at the photosensitive member unit at the opposite side to the driving side of the developing unit. With such a preferred configuration, it is possible to maintain the state in which the photosensitive member is in contact with the developing roller evenly over the entire surface regardless of the torsion, etc., of the box. Furthermore, in this case, it is preferable that the driven gear that is driven directly from the outside of the image forming unit among the driving force transmitting means for rotating the developing roller is supported rockably with the rotating axis of the developing roller as a center. With such a preferred configuration, it is possible automatically to couple a carriage, to which the image forming unit is attached, at the side of the main body to a developing driving main body gear at the side of the main body by only rotating the carriage. Furthermore, in this case, it is preferable that the image forming unit further includes a rocking member that supports the driven gear rockably, wherein the rocking member engages an anchoring portion provided at the image forming unit when the rotation force is transmitted from the outside of the image forming unit to the developing roller. With such a preferred configuration, since the rotation moment around the engagement portion is not applied from the outside of the developing unit, it is possible to bring the photosensitive member into contact with the developing roller in a stable state. Furthermore, in this case, it is preferable that the image forming unit includes anchoring portions provided at both ends of the photosensitive member and supported by the apparatus main body, and a rotation anchoring portion provided at the driving force transmitting side of the developing unit and positioning the rotation position around the rotation axis of the photosensitive member. With such a preferred configuration, since the image forming unit is supported by the apparatus main body at three points, i.e. at the engagement portion at both ends of the rotation axis of the photosensitive member and at the rotation anchoring portion, it is possible to position the photosensitive member with respect to the apparatus main body reliably. At the same time, it is possible to solve the problem that it is difficult to bring the photosensitive member into contact with the developing roller reliably because the image forming unit is subjected to a developing driving force and the unit is twisted. Furthermore, in this case, it is preferable that the rotation anchoring portion is provided in the photosensitive unit. With such a preferred configuration, since the rotation force is supported only by the photosensitive member unit, the state in which the photosensitive member is in contact with the developing roller is not affected. Furthermore, in this case, it is preferable that the rotation anchoring portion is a supporting axis that supports the developing unit rockably or a receiving portion of the supporting axis. With such a preferred configuration, at the place where the outside power is applied to the image forming unit, the carriage at the side of the main body supports the image forming unit, the excess twisting power does not occur in the image forming unit.

Furthermore, according to the fifth configuration of the image forming apparatus, an image forming apparatus includes a plurality of image forming units combining a developing device and a photosensitive member for each color; at image forming unit transmitting means for switching the image forming units by sequentially shifting the image forming unit for each color between an image forming position and other waiting positions; a positioning means for positioning the photosensitive member at the image forming position; an exposing means for exposing the photosensitive member located at the image forming position; a transfer means for transferring sequentially the toner images of many colors, which are formed on the photosensitive member at the image forming position by the developing device, to form a toner image in which toner images of many colors are overlapped on the photosensitive member; and a rotation driving means for rotating the photosensitive member and the transfer means, wherein an image forming unit according to the present invention is used as the image forming unit. According to the fifth configuration of the image forming apparatus, it is possible to position the photosensitive member reliably by a simple structure and further to form a high quality and stable image capable of securing the uniform development by pressing lightly.

DETAILED DESCRIPTION OF THE INVENTION

Hereinafter, the present invention will be described by way of embodiments with reference to drawings.

Figure 1:
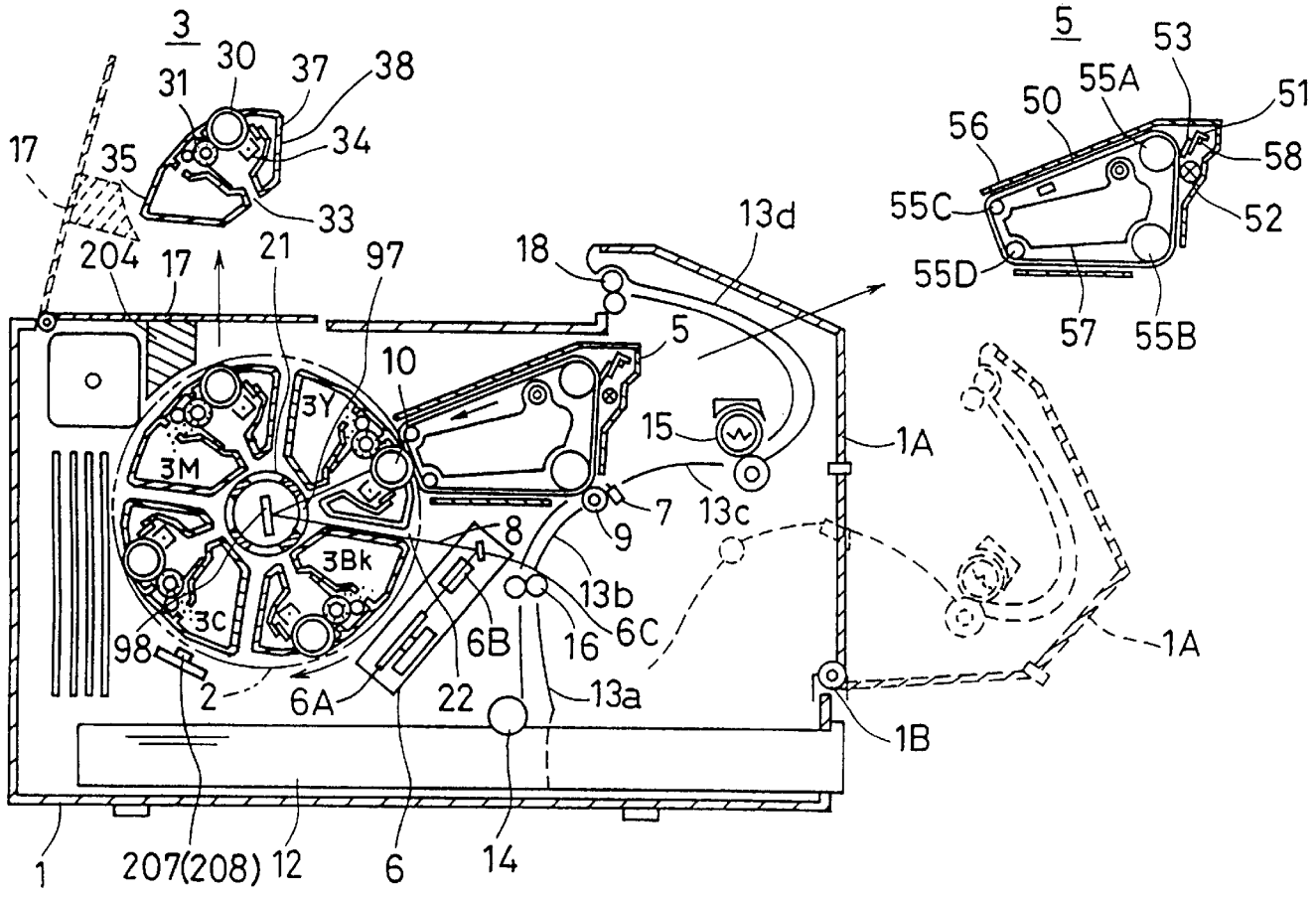
FIG. 1 is a cross-sectional view showing an image forming apparatus in one embodiment according to the present invention.
Figure 2:
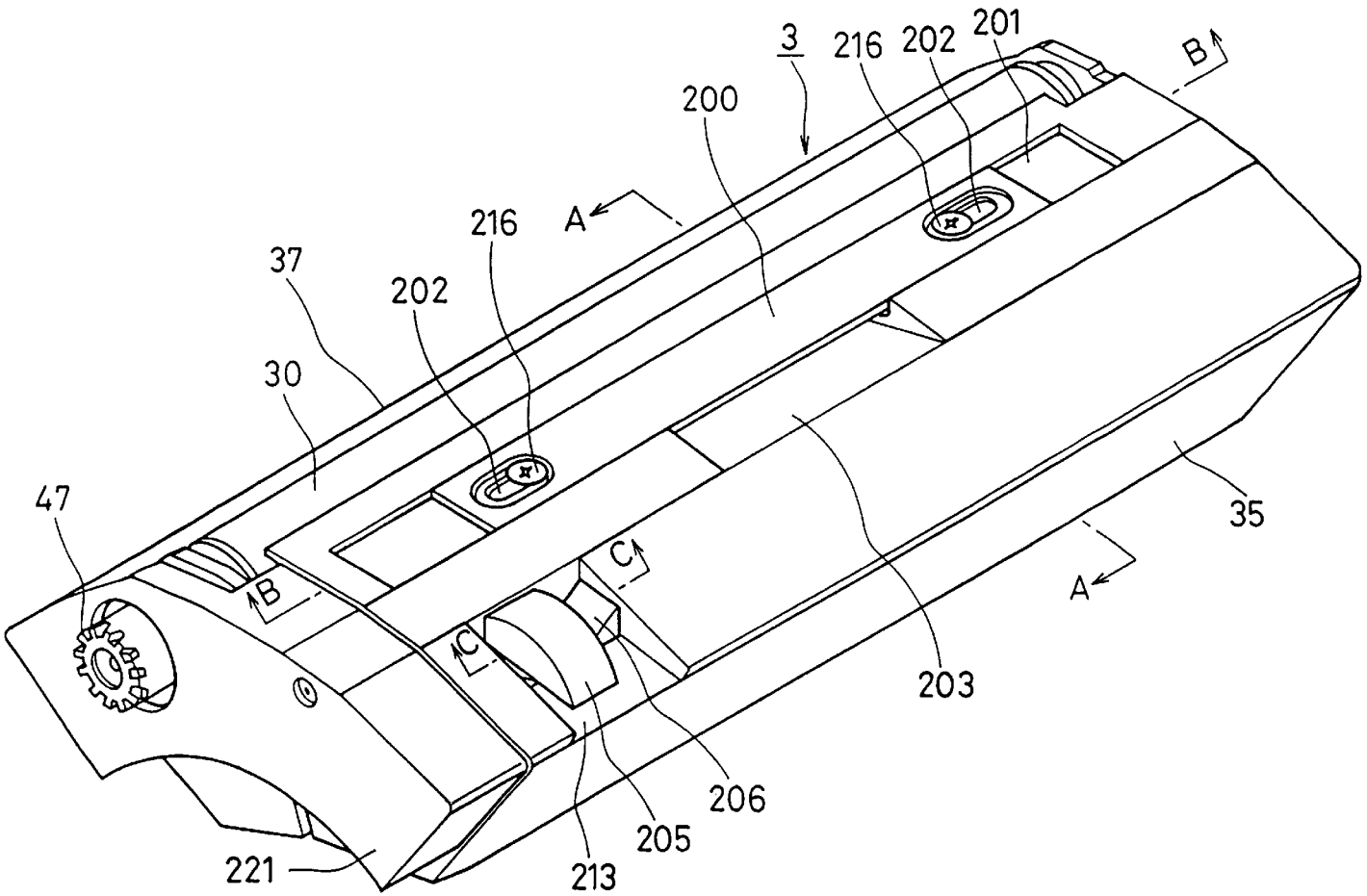
FIG. 2 is an outside perspective view showing an image forming unit in one embodiment according to the present invention.
Figure 3:
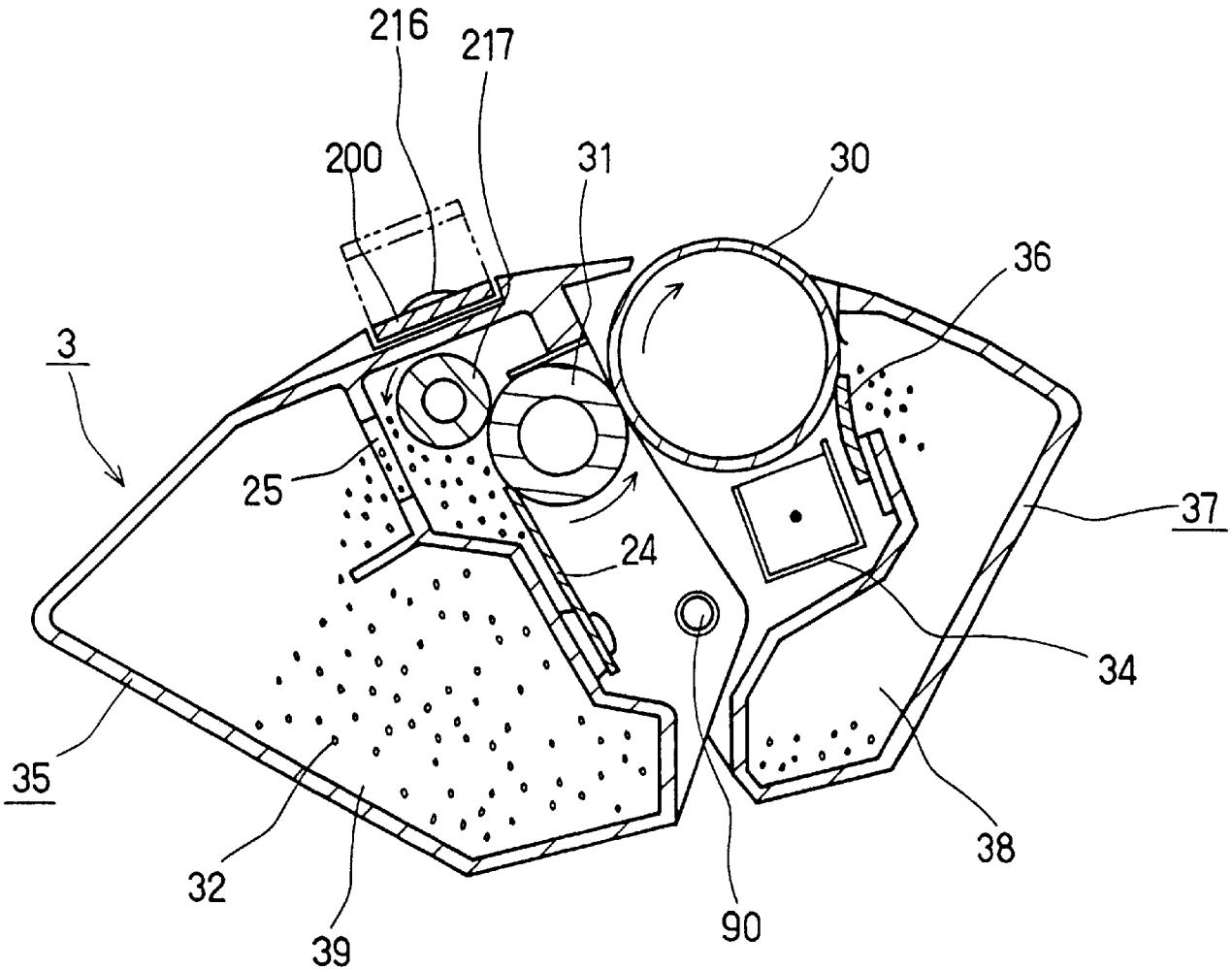
FIG. 3 is a cross-sectional view taken on line A—A of FIG. 2.
Figure 4:
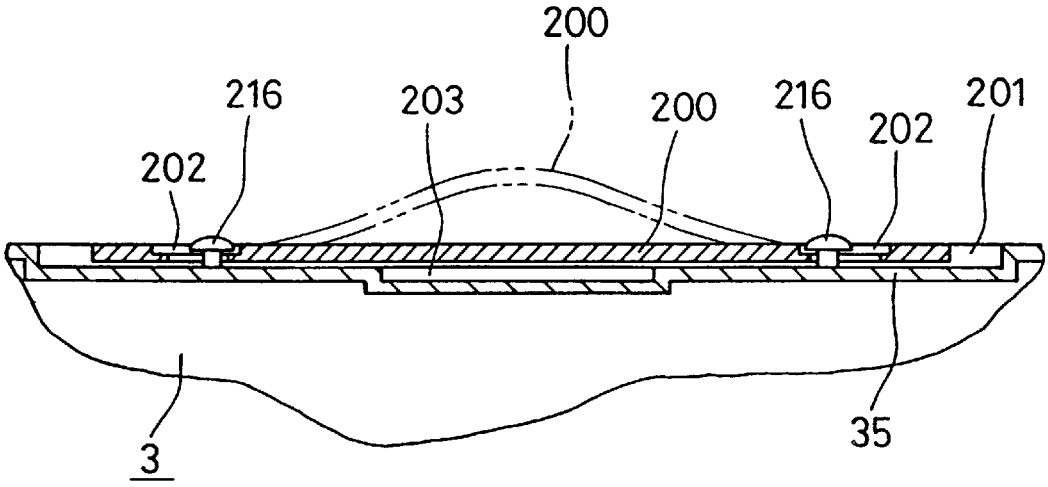
FIG. 4 is a cross-sectional view taken on line B—B of FIG. 2.
Figure 5:
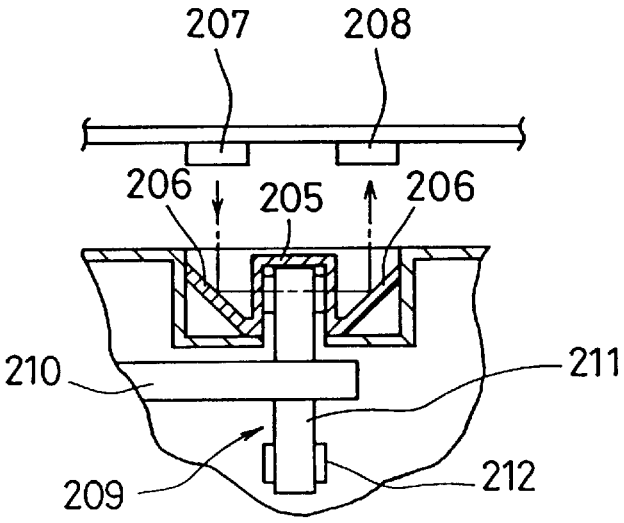
FIG. 5 is a cross-sectional view taken on line C—C of FIG. 2.
Figure 6:
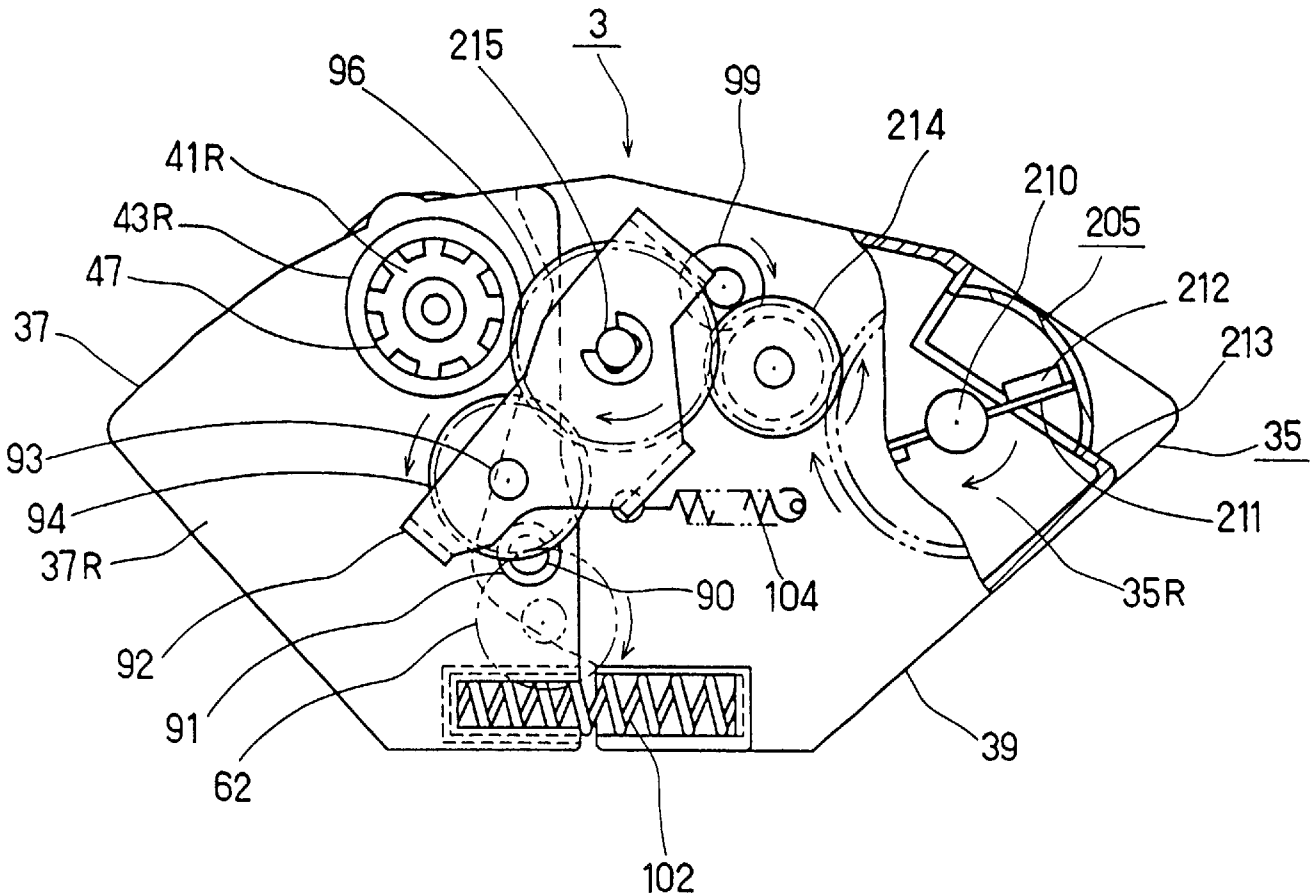
FIG. 6 is a left side view of FIG. 2 (a gear cover is not shown).
Figure 7:
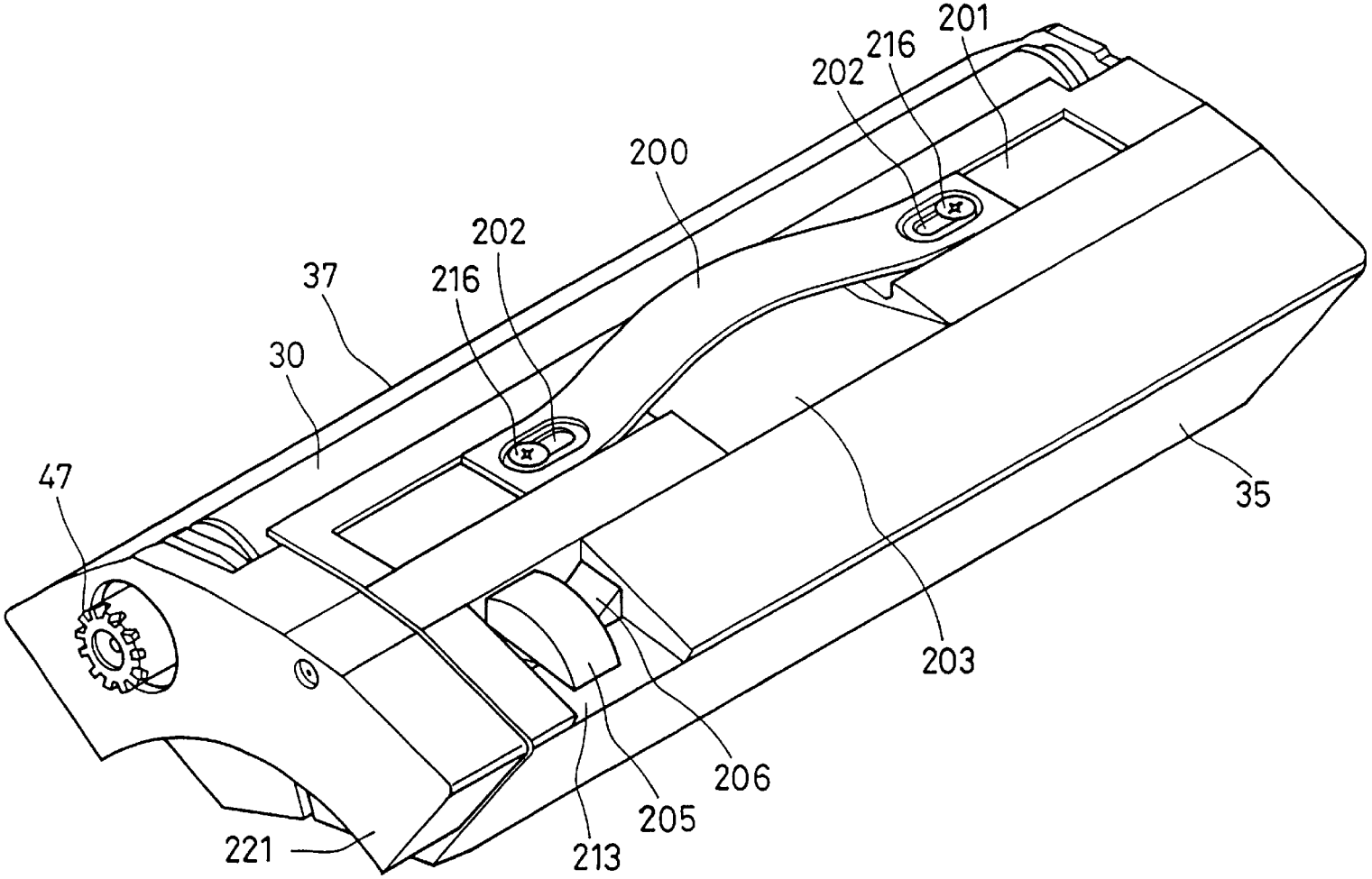
FIG. 7 is an outside perspective view showing an image forming unit when a handle is in a holdable posture in one embodiment according to the present invention.

FIG. 1 is a cross-sectional view showing a configuration of an image forming apparatus in one embodiment according to the present invention; FIG. 2 is an outside perspective view showing a configuration of an image forming unit in one embodiment according to the present invention; FIG. 3 is a cross-sectional view taken on line A—A of FIG. 2; FIG. 4 is a cross-sectional view taken on line B—B of FIG. 2; FIG. 5 is a cross-sectional view taken on line C—C of FIG. 2; FIG. 6 is a left side view of FIG. 2 (a gear cover is not shown); and FIG. 7 is an outside perspective view showing the state in which a handle of the image forming unit is in a holdable posture in one embodiment according to the present invention.

In FIG. 1, the right-hand face is the front face of the apparatus. The apparatus main body 1 includes a carriage 2 at approximately the center thereof, a front alligator 1A on the front face and a top door 17 on a top face.

In FIGS. 1 to 3, numeral 30 denotes a photosensitive member, 34 denotes a corona charger for homogeneously charging the photosensitive member 30 negatively, and 35 denotes a developing unit including a developing roller 31, a supply roller 217 for supplying toner, a doctor blade 24 for forming a toner layer, and a toner hopper 39 for containing toner 32. Numeral 36 denotes a rubber cleaning blade for cleaning off the toner that remains on the surface of the photosensitive member 30 after transfer. Numeral 38 is a waste toner case for containing the toner scraped off by the cleaning blade 36. A corona charger 34 and a photosensitive member 30 are attached to the waste toner case 38, thus forming a photosensitive member unit 37. Furthermore, the photosensitive member unit 37 and the developing unit 35 are linked rockably as one unit by a supporting pin 90 and thus an image forming unit 3 is formed. The photosensitive member 30, the developing roller 31 and the supply roller 217 are supported rotatably and rotate in the arrow direction, respectively. The toner 32 is made of polyester resin in which a pigment is dispersed and charged negatively. The toner 32 is supplied from the supply roller 217 to the developing roller 31 through a supply port 25, made into a thin film with the doctor blade 24, and then supplied to the photosensitive member 30 so as to develop an electrostatic latent image on the photosensitive member 30.

A carriage 2 as a unit-rotating member contains four image forming units 3Y, 3M, 3C and 3Bk for four colors (yellow, magenta, cyan, and black). The carriage 2 is supported on a cylinder drum 21 rotatably, thereby switching the image forming units 3 by sequentially shifting the photosensitive member 30 of the image forming unit 3 for each color between the image forming position 10 and the other waiting positions.

Inside the carriage 2, the image forming unit 3 can form images only at an image forming position 10 where the photosensitive member 30 is irradiated with a pixel laser signal light 8 and a transfer belt unit 5 is in contact with the photosensitive member 30. The image forming unit 3 is connected to a driving source or a power source of the apparatus main body 1 at the image forming position 10, thereby performing the image forming operation. The other positions are waiting positions in which the image forming units 3 are not operated.

As shown in FIGS. 2 to 4, the image forming unit 3 is provided with a handle 200 on the outer periphery of its rotating surface (a surface along the outer periphery of the carriage 2 in FIG. 1). Thus, a user can, for example, carry the image forming unit 3 by holding a handle 200 by the hand. The handle 200 is provided at the side of the developing unit 35 where heavy parts such as the developing roller 31, etc. are included. Thus, when the image forming unit 3 hangs by holding the handle 200 by the hand, balance of the unit can be maintained. Furthermore, by providing the handle 200 at the developing unit 35, it is possible to secure a sufficient space for placing the handle 200. Furthermore, since the handle 200 is provided on the outer periphery of the rotating surface of the image forming unit, it is possible to attach/detach the image forming unit 3 to/from the carriage 2 of the apparatus main body 1 easily.

The outer periphery of the rotation surface of the developing unit 35 is provided with a rectangular-shaped concave portion 201 along the longitudinal direction thereof, so that the handle 200 made of an elastic rectangular-shaped plate can be contained in the concave portion 201. With such a configuration in which the handle 200 is contained in the concave portion 201, it is possible to obtain an image forming unit 3 having a compact configuration as compared with conventional units. At both ends of the handle 200, elongated holes 202 extending along the longitudinal direction of the handle 200 are provided, and the elongated holes 202 engage anchoring members 216 provided in the concave portion 201. When the handle 200 is contained in the concave portion 201 by bringing the handle 200 into contact with the bottom surface of the concave portion 201, the anchoring member 216 is in contact with the inner end of the elongated hole 202. Moreover, the handle 200 is urged to a position in which it is contained in the concave portion 201 by its own elastic force (non-holdable posture). In this non-holdable posture, the handle 200 is located at the inner portion as compared with the rotation track surface of the photosensitive member 30. Thus, when the image forming unit 3 is rotated inside the image forming apparatus, the handle 200 is kept out of contact with the transfer belt unit 5 without requiring an additional complex operation. Moreover, the image forming unit 3 is rotated in a vertical plane while it is contained in the carriage 2 (FIG. 1). In this case, it is desirable that the elasticity of the handle 200 is set to be larger than the force by which the handle 200 takes a holdable posture, for preventing the handle 200 of the image forming unit 3 at the lowermost position from assuming a holdable posture by its self-weight.

Furthermore, on the outer periphery of the rotation surface of the developing unit 35, an entrance groove 203 is provided on the central portion in the longitudinal direction of the developing unit 35. The entrance groove 203 extends below the handle 200 with a step with respect to the concave portion 201, thereby securing a sufficient space into which a finger is inserted below the handle 200.

Since the handle 200 portion is formed as mentioned above, when putting the finger into the introducing groove 203 and holding the handle 200, the outer end portions of the elongaged holes 202 formed at both ends of the handle 200 are in contact with the anchoring member 216 by the weight of the image forming unit 3. Consequently, the state in which the handle 200 is out of the concave portion 201 (holdable posture) is realized (a state illustrated by a two-dot chain line in FIG. 4 and in FIG. 7). In this holdable posture, the handle 200 is located at an outer position from the rotation track surface of the photosensitive member 30.

It is desirable that as materials of the handle 200, ABS, polycarbonate, or the like, is used. A specific size of the handle 200 is, for example, 170 mm in length, 18 mm in width and 1.2 mm in thickness.

Figure 8:
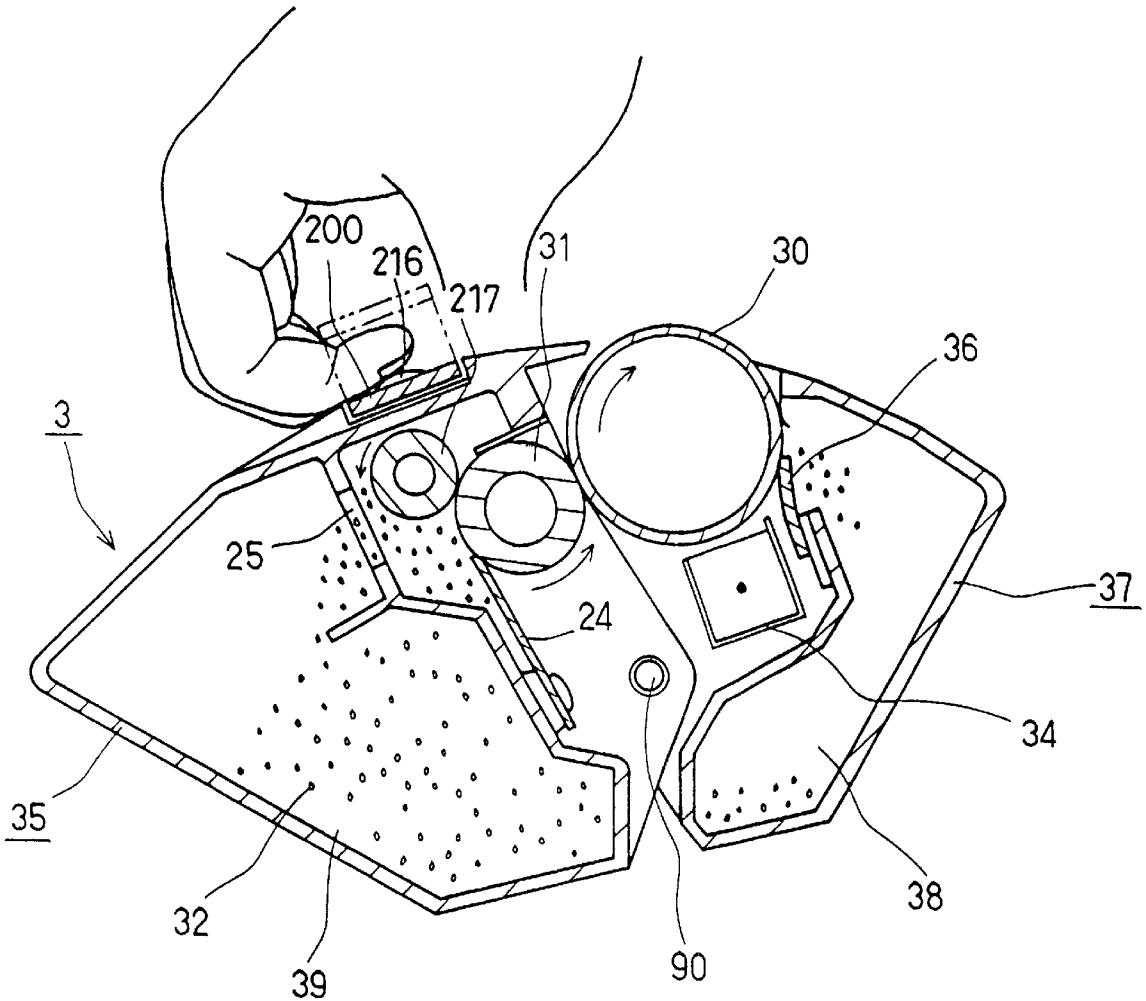
FIG. 8 is a cross-sectional view showing a state in which an image forming unit is replaced with a new one by an operator.

The image forming unit 3 is attached to the apparatus main body 1 detachably. When one of the image forming units 3 needs to be replaced with a new unit, it can be done after rotating the carriage 2 so that the image forming unit 3 of the color to be replaced is located underneath the top door 17, and opening the top door 17. Since the replacement of the image forming unit 3 is carried out by holding the handle 200 provided on the outer periphery of the rotating surface of the developing unit 35, it is easy to attach/detach the image forming unit 3 to/from the apparatus main body 1. Furthermore, the replacement of the image forming unit 3 generally is carried out from the front side of the apparatus (the right side of the image forming apparatus shown in FIG. 1) (see, FIGS. 1 and 8). Herein, the image forming unit 3, inside the carriage 2 at the replacement position, includes the photosensitive member unit 37 and the developing unit 35 in this order from the front side of the apparatus. The handle 200 is provided at the side of the developing unit 35. Namely, at the replacement position of the image forming unit 3, the handle 200 is arranged farther from the apparatus front side than the photosensitive member 30. In this way, by providing the handle 200 farther from the apparatus front side (i.e., an operators' position) than the photosensitive member 30, when the image forming unit 3 is replaced with a new unit, it is possible to prevent the operator's finger from touching the photosensitive member 30 exposed to the outside. Moreover, when the image forming unit 3 is replaced with a new unit, the top door 17 is open so as to prevent the operation of the image forming unit 3 from the rear side of the apparatus, thus inhibiting the replacement of the image forming unit 3 from the apparatus rear side. Thereby, when the image forming unit 3 is replaced with a new unit, it is possible reliably to prevent the operator's finger from touching the photosensitive member 30.

The inner surface of the top door 17 is provided with a protruding portion 204. The shape of the lower surface of the protruding portion 204 when the top door 17 is closed is a shape so that it is along the outer periphery of the carriage 2: The handle 200 can be contained in the concave portion 201 to have a non-holdable posture by its elasticity only by pushing it lightly by the finger tip. Therefore, by providing the protruding portion 204 on the inner surface of the top door 17, even if a user forgets to keep the handle in a non-holdable posture, as long as the top door 17 is closed after the image forming unit 3 is replaced with a new unit, the lower surface of the protruding portion 204 can be brought into contact with the handle 200 so as to urge the handle 200 toward the non-holdable posture (a state illustrated by a two-dot chain line in FIG. 4 and a state in FIG. 7).

Furthermore, as shown in FIGS. 2, 5 and 6, a toner detection case 205 as a detection window having an arc-shaped cross section is provided at the end in the longitudinal direction of the developing unit 35 positioned at the corner of the outer periphery of the rotation surface of the developing unit 35. This toner detection case 205 is formed in the cavity 213 formed in a toner hopper 39. The toner detection case 205 is formed continuously with the toner hopper 39. The toner detection case 205 is made of a translucent member. On both sides of the toner detection case 205, reflection planes 206 are provided at an angle of 45° with respect to the side faces of the toner detection case 205, respectively. As shown in FIG. 5, a light beam emitted from a light emitting element 207 arranged facing the toner detection case 205 on the outer periphery of the rotation surface of the developing unit 35 is reflected from one of the reflection planes 206, is incident on the toner detection case 205 from one side face (a detection window) of the toner detection case 205, and is released from the other side face (a detection window) and the light reflected from the other reflection plane 206 is received by a light receiving element 208 arrange facing the toner detection case 205 on the outer periphery of the rotation surface of the developing unit 35. In the above-mentioned process, the amount of toner that remains in the toner hopper 39 is detected. That is, since the amount of light beam received at a light-receiving element 208 differs depending upon the amount of toner remaining in the toner hopper 39 (the amount of toner in the toner detection case 205), the amount of toner in the toner hopper 39 can be detected. By detecting the amount of toner remaining in the toner hopper 39 with the above-mentioned configuration, it is not necessary to arrange the detection members such as a light emitting element 207, a light-receiving element 208, etc. in the cavity 213 provided in the toner hopper 39. Also, it is necessary to put/take the detection members into/out of the cavity 213. Furthermore, it is possible to make-the detecting light path as short as possible. In addition, since the toner detection case 205 is made of a translucent member, it is possible to check the remaining amount of toner visibly by taking out the image forming unit 3 from the apparatus main body 1 It is desirable that the material constituting the toner detection case 205 includes acrylic resins, polystyrene resin, or the like.

The light emitting element 207 and the light-receiving element 208 are arranged near the carriage 2 so that they can detect the amount of toner remaining in the toner hopper 39 of the image forming unit 3 (a cyan image forming unit 3C in FIG. 1) positioned at the opposite side of the image position 10 shown in FIG. 1. In other words, the position for detecting the amount of remaining toner is positioned at a lower part with respect to the horizontal line including the rotation center of the carriage 2. At this detection position, since the toner detection case 205 is located at the bottom portion of the toner hopper 39, it is possible to detect the amount of toner even if it is only a small amount. Moreover, as shown in FIG. 1, at the image forming position 10, toner in the toner hopper 39 is collected to the inner periphery of the carriage 2. Therefore, if the amount of remaining toner is detected at the image forming position 10, it is necessary to provide the light emitting element 207, the light receiving element 208, and the like, at the inner periphery of the carriage 2. Thus, it is made to be difficult to place the light emitting element 207, the light-receiving element 208, and the like. However, as mentioned above, by detecting the amount of remaining toner at the different position and posture from those of the image forming position 10, it is possible easily to place the light emitting element 207, the light-receiving element 208, and the like, for detecting the amount of remaining toner.

As shown in FIGS. 5 and 6, inside the toner detection case 205 is a cleaning member 209 for cleaning the inner wall of the toner detection case 205. The cleaning member 209 includes a cleaning member main body 211 supported rotatably by the central axis 210 and a cleaning blade 212 protruding from the both ends of the cleaning member main body 211. Then, the arc-shaped surface of the toner detection case 205 is cleaned with the both ends of the cleaning member main body 211 and both side walls (detection window) of the toner detection case 205 are cleaned with the blades 212. By providing the cleaning member 209 for cleaning off the inner surface of the toner detection case 205 inside the toner detection case 205, it is possible to enhance the accuracy in detecting the amount of remaining toner appropriately by cleaning the inner wall of the toner detection case 205. The driving method of the cleaning member 209 is described later.

In FIGS. 2 and 7, numeral 221 denotes a gear cover. A transfer belt unit 5 receives a toner image formed on the photosensitive member 30 of the image forming unit 3 at the image forming position 10 and transfers again the received toner image onto the recording paper. The transfer belt unit 5 includes an intermediate transfer belt 50, a group of pulleys (a driving pulley 55A, a back-up pulley 55B, a guide pulley 55C and a tension pulley 55D) for suspending the intermediate transfer belt 50, a cleaner 51 and a waste toner case 57 for containing the waste toner after cleaning. These members are formed into one unit, and the unit is attached to the apparatus main body 1 detachably.

The intermediate transfer belt 50 is an endless belt having a thickness of about 100 $\mu$m, and is made of a film of semiconductive (middle resistivity) urethane coated with a fluororesin such as PFA, PTFE, or the like. The total thickness of this films is set in the range from 100 to 300 $\mu$m. The peripheral length of the intermediate transfer belt 50 is set to be a little bit more than the length corresponding to the maximum length of the A4 recording paper size (297 mm) accepted, so that A4 size or letter size recording paper can be used for full color printing.

Numeral 51 denotes a cleaner, which cleans the toner remaining on the intermediate transfer belt 50. This cleaner 51 includes a cleaning blade 53 made of rubber, and a screw 52 for carrying scraped toner into the waste toner case 57. This cleaner 51 is placed so that it can rotate with a supporting point 58 as a center and is separated from the transfer belt 50 in order not to scrape off a toner image on the intermediate transfer belt unit 50 when forming a color image on the intermediate transfer belt 50.

Among the group of pulleys suspending the intermediate transfer belt 50, the pulley 55A is a driving pulley for driving the intermediate transfer belt 50, which also has a function of backing up the cleaning blade 53. The pulley 55B is a back-up pulley backing up a secondary transfer roller 9 that transfers a toner image on the intermediate transfer belt 50 onto the recording paper. The pulley 55C is a guide pulley that also functions as a roller for applying a primary transfer bias for transferring the toner image onto the intermediate transfer belt 50 from the photosensitive member 30. The pulley 55D is a tension pulley providing the intermediate transfer belt 50 with a tension. These pulleys 55A, 55B, 55C, and 55D suspend the intermediate transfer belt 50. The intermediate transfer belt 50 can be rotated by the rotation of the driving pulley 55A. Numeral 56 denotes a cover for protecting the intermediate transfer belt 50.

A transfer belt unit 5 is positioned reliably at a predetermined position when it is attached to the apparatus main body 1, and the portion facing the image forming position 10 is in contact with the photosensitive member 30 of the image forming unit 3. Furthermore, at the same time, each portion of the transfer belt unit 5 is connected electrically to the side of the apparatus main body and the driving pulley 55A is connected to the driving means at the side of the apparatus main body. Thereby, intermediate transfer belt 50 can be rotated.

Furthermore, numeral 7 denotes an electricity-removing needle, which prevents a toner image from being disturbed when the recording paper is separated from the intermediate transfer belt 50.

Numeral 6 denotes a laser exposure device, which is placed underneath the transfer belt unit 5. The laser exposure device 6 includes a semiconductor laser (not shown), a polygon mirror 6A, a lens system 6B, a first mirror 6C, and the like. The pixel laser signal light 8 corresponding to a transient serial electrical pixel signal for image information passes through an optical path 22 formed between a photosensitive member unit 37 of a yellow image forming unit 3Y and the developing unit 35 of a black image forming unit 3Bk. The pixel laser signal light 8 passes through an exposure window 97 of the cylinder drum 21; is incident on the second mirror 98 of the cylinder drum 21 (the second mirror 98 is fixed in place regardless of the movement of the cylinder drum 21), which is fixed to the apparatus main body 1; is reflected from the second mirror 98 and incident into an exposure portion of the left side face of the photosensitive member 30 located at the image forming position 10 while passing through the gap provided between the photosensitive member unit 37 and the development unit 35 of the yellow image forming unit 3Y, so as to scan and expose the photosensitive member 30 in the direction of the main line.

Numeral 12 denotes a paper feed unit, 14 denotes a paper feed roller, 16 denotes a resist roller, 18 denotes a paper ejecting roller, and 13*a*, 13*b*, 13*c*, and 13*d* denote a paper guide, respectively, which link between the above-mentioned rollers as well as between the contact point of the intermediate transfer belt 50 and the secondary transfer roller 9 and a fixing device 15.

The front alligator 1A is hinged to the apparatus main body 1 with a hinge axis 1B, and can be lowered and opened toward the front. The front alligator 1A is provided with the fixing device 15, a secondary transfer roller 9, the electricity-removing needle 7, a front side of the paper guide 13*a*, 13*b*, 13*c* and 13*d*, and the front side of the resist roller 16. When the front alligator 1A is lowered toward the front, these components also are lowered toward the front together. Therefore, it is possible to open the front surface of the it apparatus main body 1 widely and to attach/detach the transfer belt unit 5 into/from this opened part. At the same time, it is possible to remove paper easily at the time of paper jamming.

Figure 9:
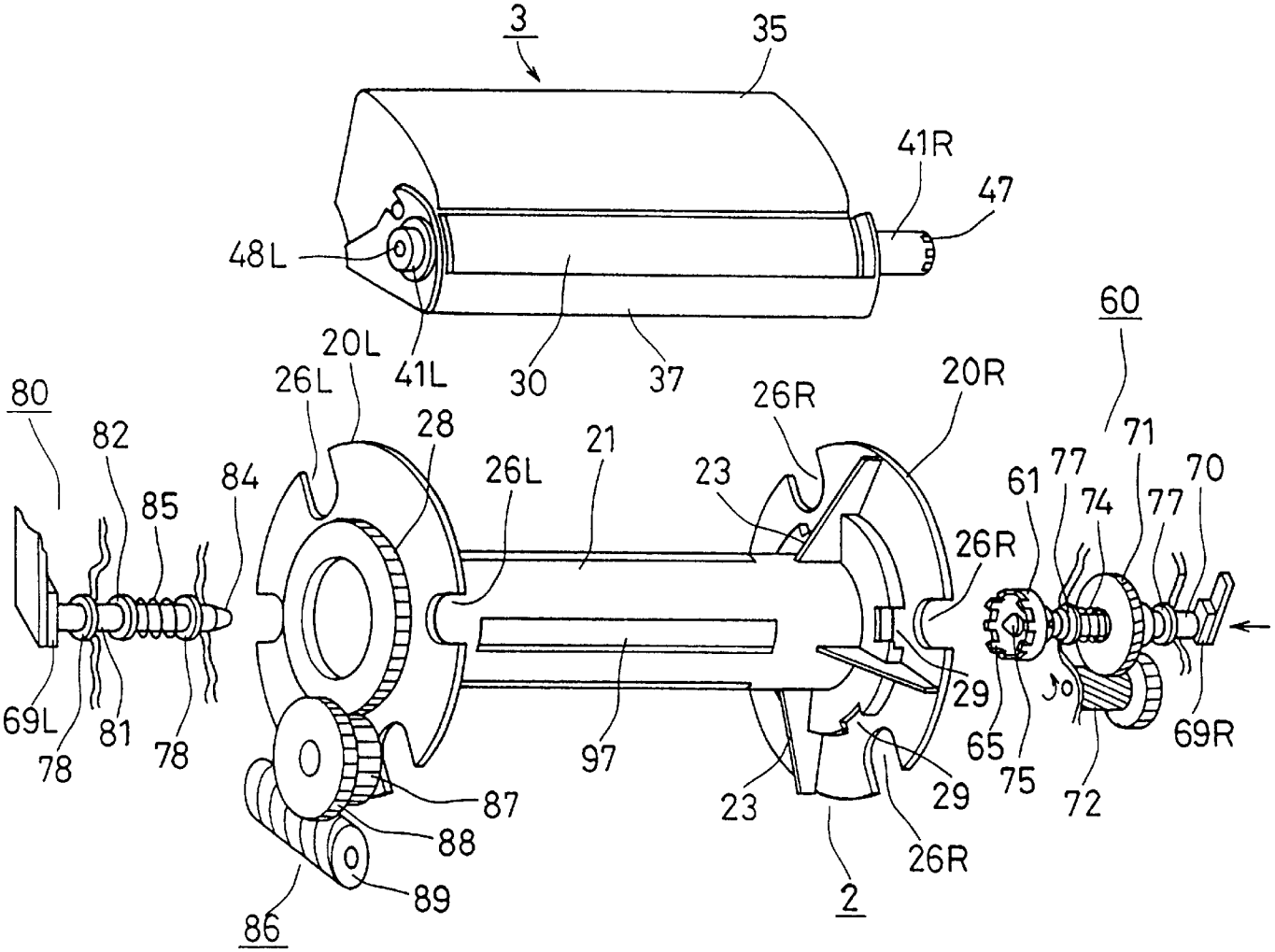
FIG. 9 is an exploded perspective view showing a positioning mechanism of a carriage and a photosensitive member and a driving mechanism in one embodiment according to the present invention.
Figure 10:
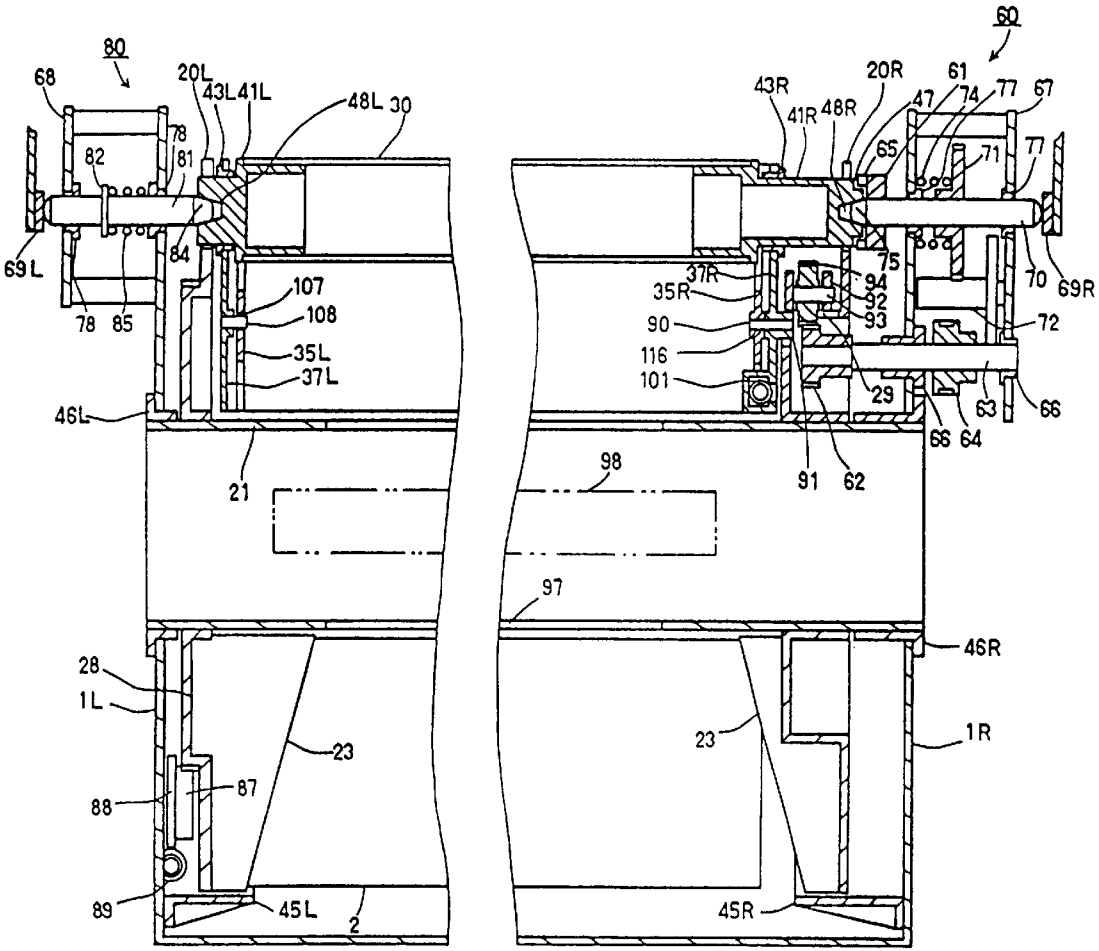
FIG. 10 is a cross-sectional view showing a carriage taken on a line passing the image forming position of the image forming apparatus in one embodiment of the present invention.

The following is a detailed description of a positioning mechanism and a driving mechanism for performing precise color alignment of all colors in the image forming position 10, with reference to FIGS. 9 and 10.

FIG. 9 is an exploded perspective view showing a positioning mechanism of a carriage and a photosensitive member and a driving mechanism in one embodiment according to the present invention. FIG. 10 is a cross-sectional view showing a carriage taken on a line passing the image forming position of the image forming apparatus in one embodiment according to the present invention.

As shown in FIGS. 9 and 10, flanges 41R and 41L having taper holes 48R and 48L for positioning the image forming unit 3 are adhered to the both ends of the photosensitive member 30. The outer peripheries of the flanges 41R and 41L are attached rotatably to photosensitive member bearings 43R and 43L fixed to the side wall of the photosensitive member unit 37. The tip of the flange 41R is provided with a coupling tongue 47 for rotating the photosensitive member 30. The coupling tongue 47 can engage a coupling plate 61 of the main body side.

The carriage 2 has a right wall 20R and a left wall 20L, which are fixed to the cylindrical drum 21 provided in the center of the carriage 2. Partition ribs 23 for partitioning the carriage 2 into four sections are fixed to the right and left walls 20R and 20L. An image forming unit 3 for each color is installed in each space in the carriage 2, which is partitioned with the partition ribs 23. The cylindrical drum 21 has a total of four exposure windows 97 at positions corresponding to the positions where the pixel laser signal light 8 for exposing the photosensitive member passes through. The carriage 2 is supported rotatably by right and left side walls 1R and 1L of the apparatus main body via bearings 46R and 46L.

Numeral 28 denotes a carriage gear, which is integrally formed on the outside of the left wall 20L, and connected to a carriage driving mechanism 86 provided at the side of the main body. The carriage driving mechanism 86 includes a worm 89 connected to a driving source (not shown), a worm wheel 88, and a gear 87 that is formed into one piece with the worm wheel 88 and meshes with the carriage gear 28. The carriage 2 is positioned at the rotation position freely by means of the carriage driving mechanism 86.

Numerals 45R and 45L denote drop prevention guides for preventing the image forming unit 3 provided at about the lower half along the outer periphery of the carriage 2 from dropping out of the carriage 2. The drop prevention guides 45R and 45L are fixed to the side walls 1R and 1L of the main body, respectively.

Moreover, the second mirror 98 is attached firmly to the side walls 1R and 1L of the main body with a fixing member (not shown) around the center of the cylindrical drum 21 and is fixed in position regardless of the rotation of the carriage 2.

The side walls 20R and 20L are provided with cutouts 26R and 26L at the portion of the image forming unit 3 into which flange 41R and 41L are inserted. The cutouts 26R and 26L and the partition ribs 23 serve as a guide when the image forming unit 3 is attached to the inside of the carriage 2. At the side part or the lower part of the carriage 2, the image forming unit 3 is guided by the drop prevention guides 45R and 45L, so that it is not detached from the carriage 2.

The sizes of the cutouts 26R and 26L set to be larger than those of the outer diameter of the flanges 41R and 41L, so that there is a play, in all directions, between the photosensitive member 30 and the carriage 2 of regular position, when the photosensitive member 30 is positioned at the image forming position 10 to be in the standard position. In this embodiment, about 1 mm of space is secured. Thereby, even if the positioning of the carriage 2 is not so precise, the positioning operation of the photosensitive member 30 is not affected.

A photosensitive member driving mechanism 60 and a detent mechanism 80 are provided at the side walls 1R and 1L of the apparatus main body 1 in order to position the photosensitive member 30 precisely at the image forming position 10.

The photosensitive member driving mechanism 60, which is attached to the right side wall 1R of the main body, includes an output axis 70, a coupling plate 61 that is fixed to the output axis 70 and rotates together as one piece with the output axis 70, an output axis driving gear 71, and a driving mechanism for driving these elements mentioned above. The output axis 70 is supported, movably in the thrust direction and rotatably, by the bearings 77 fixed to the side right wall 1R of the main body and a base plate 67.

One end of the output axis 70 has a tip-tapered portion 75, which has a convex tapered surface corresponding to the tapered hole 48R of the photosensitive member 30. The other end of the output axis 70 has a spherical shape so as to be in contact with a thrust bearing 69R with small area. The output axis driving gear 71 is a helical gear that is fixed to the output axis 70 and meshes with a motor-side gear 72. Numeral 74 denotes a compression spring, which is inserted between the bearing 77 and the output axis driving gear 71. This compression spring 74 constantly urges the output axis 70 and the coupling plate 61 toward the position that is separated from the flange 41R of the photosensitive member 30 (FIG. 10 shows a state in which the coupling plate 61 engages the flange 41R).

The output axis 70 can move against the spring force by a driving means (not shown) that moves the thrust bearing 69R, between a position separated from the flange 41R and a position where the taper hole 48R shown FIG. 10 engages the tip-tapered portion 75. The motor-side gear 72 has a sufficient tooth width so that the output axis driving gear 71 meshes with the motor-side gear 72 in any position. When the output axis 70 moves in the thrust direction, the output axis driving gear 71 and the motor-side gear 72 slide against each other on the tooth surfaces.

Numeral 61 is a coupling plate, which meshes with the coupling tongue 47 of the flange 41R so as to transmit the power, and has eight coupling tongues 65 on its tip end.

Next, the following is a description of the detent mechanism 80, which is attached to the left side wall IL of the main body.

The detent mechanism 80 is supported between a left side wall 1L of the main body and the base plate 68 via the bearing 78. The detent mechanism 80 includes a detent axis 81 capable of moving in the thrust direction and rotating by a driving mechanism (not shown) moving a thrust bearing 69L and a compression spring 85. One end of the detent axis 81 has a convex tapered surface 84 corresponding to the tapered hole 48L of the flange 41L. The other end of the detent axis 81 has a spherical shape, similar to the output axis 70, and pressed onto the thrust bearing 69L. Numeral 85 denotes a compression spring, which is inserted between the left side wall 1L of the main body and a spring stopper 82 fixed to the detent axis 81. The compression spring 85 keeps the detent axis 81 separated from the flange 4L.

With the above-mentioned configuration, when the image forming unit 3 supported by the carriage 2 is carried to the image forming position 10 and stops while the output axis 70 and the detent axis 81 are separated from the flanges 41R and 41L of the photosensitive member 30, the thrust bearings 69R and 69L are pushed inwardly by the driving mechanism, respectively. Consequently, the tip-tapered portion 75 of the output axis 70 engages the taper hole 48R of the flange 41R, and a taper surface 84 of the detent axis 81 engages the taper hole 48L of the flange 41L, respectively.

Thus, the photosensitive member 30 is positioned precisely at the image forming position 10. When the output axis driving gear 71 is rotated with the output axis 70 and the detent axis 81 pressed inwardly, since the coupling tongue 65 of the coupling plate 61 engages the coupling tongue 47 of the flange 41R, the rotation of the output axis 70 is transmitted to the photosensitive member 30, whereby the photosensitive member 30.is rotated at the image forming position 10. At this time, all of the photosensitive member 30 supported by the output axis 70 and the detent axis 81, the second mirror 98 and the laser exposure device 6 are positioned in the apparatus main body 1. Therefore, the photosensitive member 30 can be positioned precisely regardless of the position of the carriage 2. As a result, even if the image forming units 3 are switched, the photosensitive member 30 can be positioned precisely, inhibiting an occurrence of the color misalignment.

The following is a description of a configuration of the image forming unit 3 and a driving mechanism of the developing roller 31, with reference to FIGS. 6 and 10 to 12.

Figure 11:
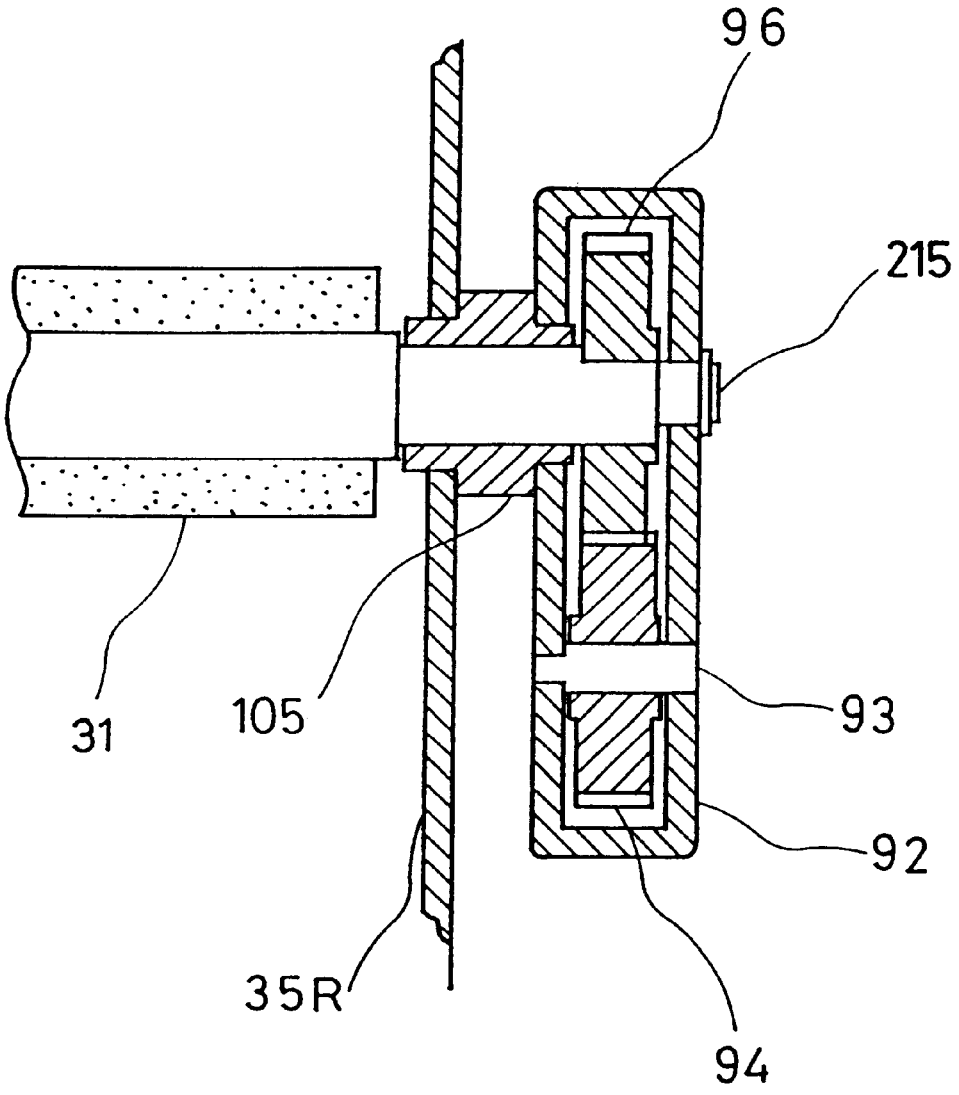
FIG. 11 is a cross-sectional view showing a rocking lever provided in a developing unit in one embodiment of the present invention.
Figure 12:
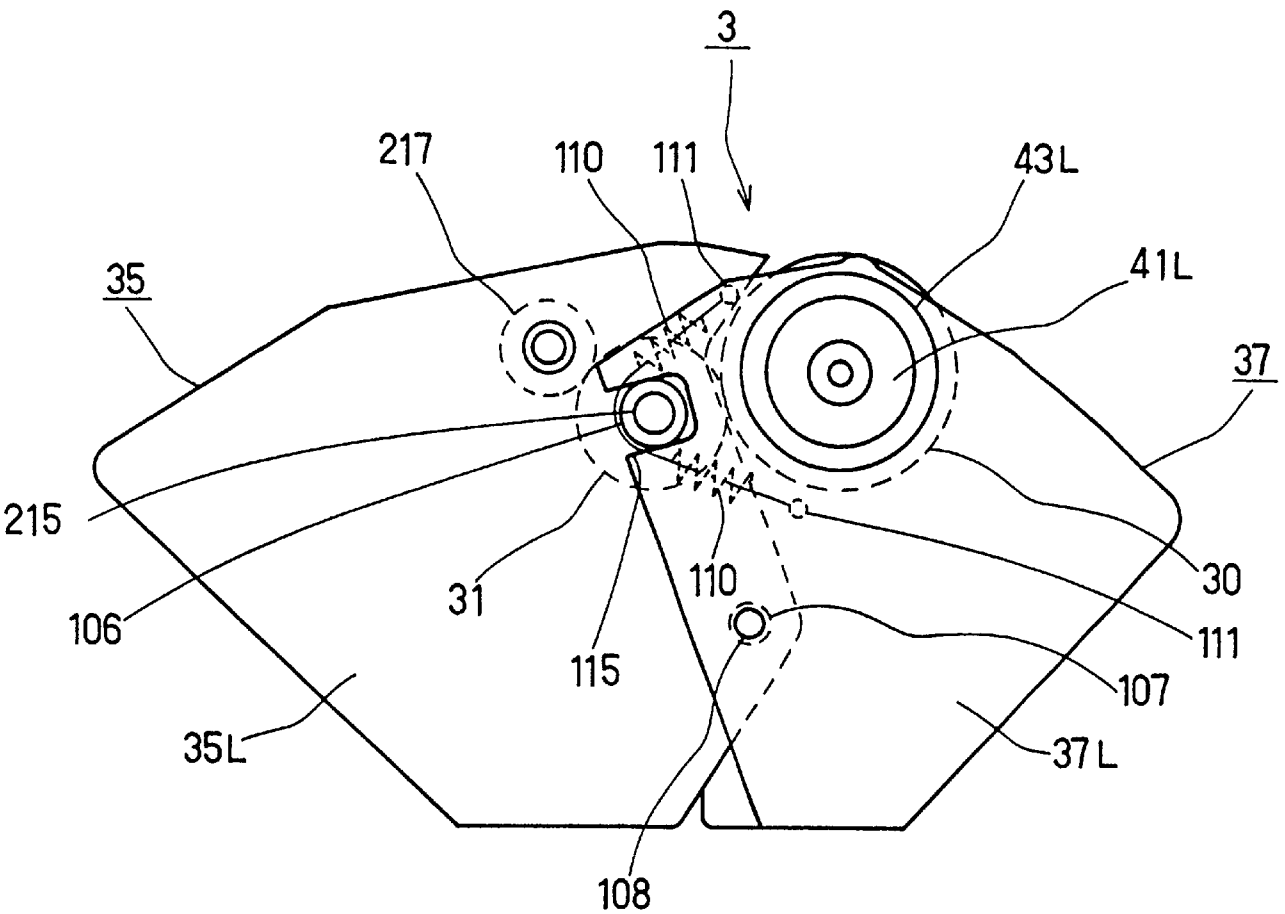
FIG. 12 is a right side view of FIG. 2.

FIG. 11 is a cross-sectional view showing a rocking lever provided in a developing unit in one embodiment of the present invention. FIG. 12 is a right side view of FIG. 2.

First, the following is a description of how the photosensitive member unit 37 is connected to the developing unit 35 in the image forming unit 3.

As shown in FIGS. 6, 10 and 12, the right side wall 37R of the photosensitive member unit 37 is provided with a protruding portion 91 to which a supporting pin 90 is press-fitted. Furthermore, a guide pin 108 is press-fitted to the left side wall 37L of the photosensitive member unit 37. Numeral 115 denotes guide grooves, which are formed on the left side wall 37L of the photosensitive member unit 37. These guide grooves 115 guide the developing roller 31 in the direction of the photosensitive member 30. The developing unit 35 is placed inside of the both side walls 37R and 37L of the photosensitive member unit 37. At the right side wall 37R of the photosensitive member unit 37, the supporting pin 90 is inserted into the positioning hole 116 so as to be supported rotatably.

As shown in FIGS. 6 and 10 to 12, the developing roller 31 is supported rotatably by the bearings 105 and 106, which are fixed respectively to the right side wall 35R and the left side wall 35L of the developing unit 35. The bearing 106 is fitted into the guide groove 115 at the side of the left side wall 37L of the photosensitive member unit 37. The left side of the developing unit 35 can move along the guide groove 115 together as one piece with the developing unit 35 with respect to the photosensitive member unit 37. The guide pin 108 is inserted into a hole 107 provided on the left side wall 35L of the developing unit 35. However, the guide pin 108 is arranged with about 1 mm of play with respect to the hole 107, and so the positioning is not performed by this insertion.

The photosensitive member unit 37 and the developing unit 35 are combined in the above-mentioned configuration. The right side wall 37R of the photosensitive member unit 37 and the right side wall 35R of the developing unit 35 are rotated, with the supporting pin 90 as a center, by means of the compression spring 102 suspended between them, and thereby the developing roller 31 stops with the developing roller 31 pressed by the photosensitive member 30. Furthermore, the left side wall 37L of the photosensitive member unit 37 and the left side wall 35L of the developing unit 35 stop in a state in which the developing roller 31 is attracted to the side of the photosensitive member 30 with a tension coil spring 110 suspended between the bearing 106 of the developing roller 31 and a pin 111 provided at the left side wall 37L of the photosensitive unit 37, and thus the developing roller 31 is pressed onto the photosensitive member 30.

As mentioned above, in this embodiment, since the photosensitive member 30 of the image forming unit 3 is in contact with the developing roller 31 at three points, i.e. at the supporting pin 90, at the right side of the developing roller 31, and at the left side of the developing roller 31, it is possible to bring the photosensitive member 30 into contact with the developing roller 31 uniformly and at a certain pressure without being affected by the size accuracy of the photosensitive unit 37 or the developing unit 35.

The following is a description of the driving mechanism of the developing roller 31.

As shown in FIGS. 6 and 10 to 11, the developing roller 31 is driven to be rotated via a developing driving main body gear 62, a rocking gear 94, and a developing roller gear 96 fixed to a developing roller 31. The developing driving main body gear 62 is fixed to a developing driving axis 63 attached rotatably to the right side 1R of the main body and a base plate 67 via a bearing 66. The developing driving axis 63 is rotated from the side of the main body via the developing driving pulley 64 fixed to the developing driving axis 63. Numeral 99 is a gear fixed to the feeding roller 21. This gear 99 is driven to be rotated via a developing roller gear 96 and an idler gear 214.

As mentioned above, since the driving force for rotating the developing roller 31 is applied from the outside (main body side) of the image forming unit 3, the photosensitive member 30 is not subjected to a load fluctuation as the photosensitive member 30 drives the developing roller 31. Moreover, since a contact pressure of the developing roller 31 to the photosensitive member 30 can be set to be small, the photosensitive member 30 is not susceptible to the disturbance from the developing roller 31, whereby the stable rotation can be secured.

As shown in FIGS. 6 and 11, the rocking gear 94 is attached rotatably to the rocking lever 92 via a pin 93. The rocking lever 92 is attached rockably to the bearing 105 of the right side wall 35L of the developing unit 35 and the developing roller axis 215 with the developing roller axis 215 as a center. The tension spring 104 is suspended to the rocking lever 92, whereby the rocking gear 94 is energized to the side of the developing driving main body gear 62. However, the bottom face of the rocking lever 92 is in contact with the circular protruding potion 91 around the supporting pin 90 of the right side wall 37R of the photosensitive member unit 37. Moreover, the rocking lever 92 may be directly in contact with the supporting pin 90. With such a configuration in which the rocking lever 92 is received by the supporting pin 90 or a circular protruding portion 91, the carriage 2 at the main body side supports the image forming unit 3 at the portion where an external force is applied to the developing unit 35. Therefore, an excess torsional power is not applied to the image forming unit 3.

When the carriage 2 to which the image forming unit 3 is installed is driven to be rotated, the tooth tips of the developing driving main body gear 62 and the rocking gear 94 are hitting each other, the rocking lever 92 is rotated against the force of the tension spring 104, and thus the rocking gear 94 is separated away from the developing driving main gear 62. When the image forming unit 3 reaches the image forming position 10, the rocking gear 94 reaches the developing driving main body gear 62. However, the rocking lever 92 is in contact with the circular protruding portion 91 to be stopped. Therefore, the length between the center of the rocking gear 94 and that of the developing driving main body gear 62 is secured correctly, whereby the developing roller 31 is rotated in contact with the photosensitive member 30.

Furthermore, as shown in FIG. 6, the cleaning member main body 211 of the cleaning member 209 for cleaning the inner wall of the toner detection case 205 is rotated via a developing driving main body gear 62, the rocking gear 94, the developing roller gear 96 and the idler gear 214. That is, when the photosensitive member 30 of the image forming unit 3 is positioned at the image forming position 10, and the rocking gear 94 meshes with the developing driving main body gear 62, the cleaning member main body 211 is driven to be rotated. Therefore, the cleaning of the toner detection case 205 is performed only at the image forming position 10. The cleaning of the toner detection case 205 is not performed at the position for detecting the amount of remaining toner. In this way, at the position for detecting the amount of remaining toner, the cleaning member main body 211 is not driven to be rotated, and the detecting light is not shielded by the cleaning member main body 211. Therefore, it is possible to detect the amount of remaining toner precisely. Furthermore, by performing the cleaning of the toner detection case 205 only at the image forming position 10, it is not necessary to provide the mechanism for rotating the cleaning member main body 211 in addition to the image forming position 10, thus simplifying the structure of the apparatus. Moreover, a member for stirring toner inside the toner hopper 39 is not provided in the image forming unit of this embodiment, there may arise a case where the amount of remaining toner cannot be detected precisely. However, during the several times of rotation of the carriage 2, the amount of remaining toner in the image forming unit 3 of one color is detected several times and the detected results are obtained, and the amount of the remaining toner is determined based on the detected results. Thus, it is possible to reduce the detection error and to detect the amount of remaining toner accurately.

Figure 13:
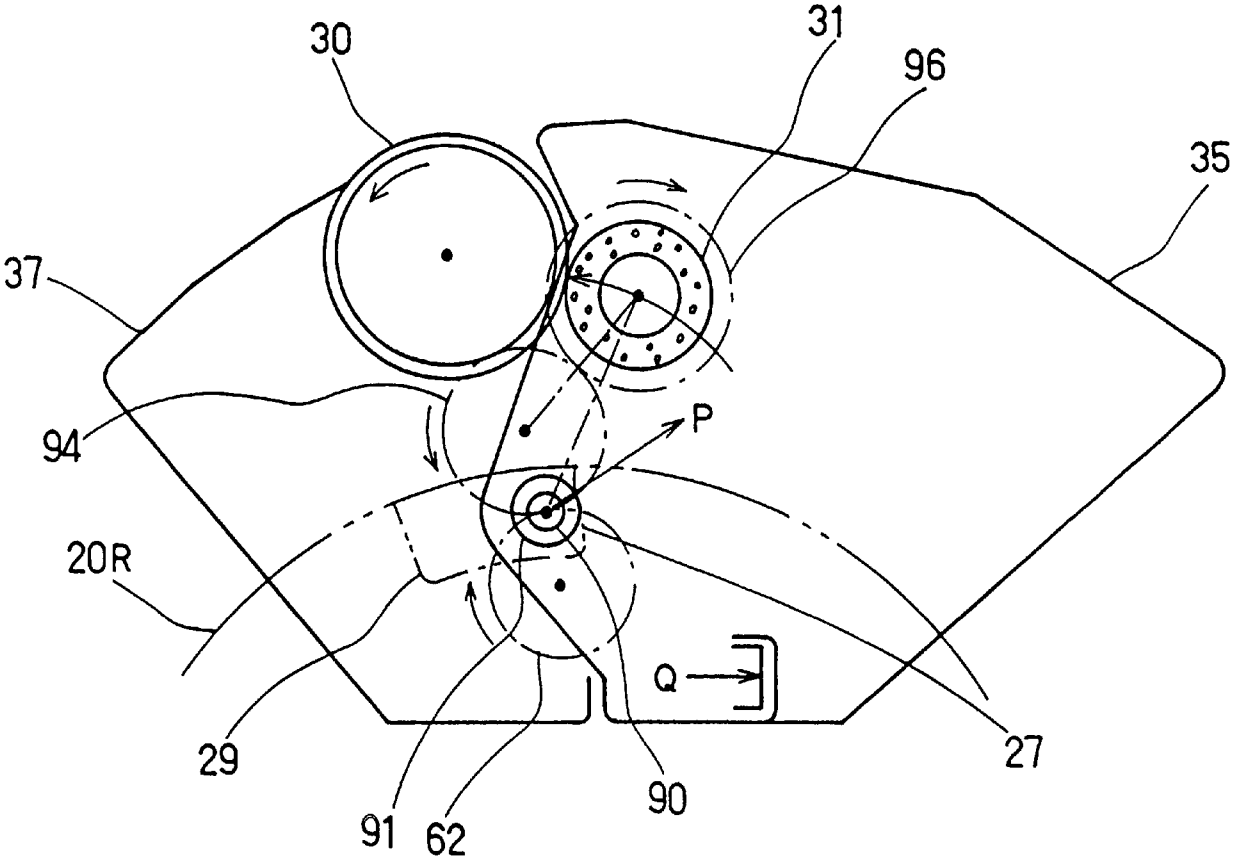
FIG. 13 is a view to explain how a photosensitive member and a developing roller are driven in one embodiment according to the present inventions
Figure 14:
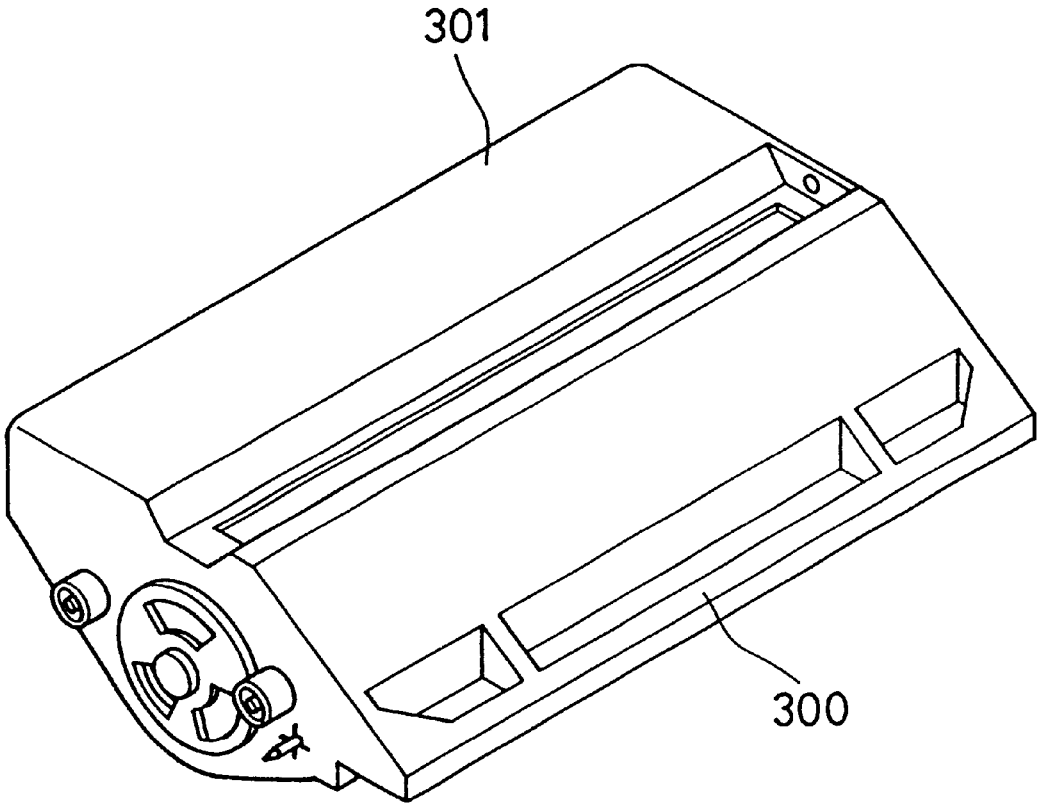
FIG. 14 (PRIOR ART)
FIG. 14 is an outside perspective view showing a conventional image forming unit.
Figure 15:
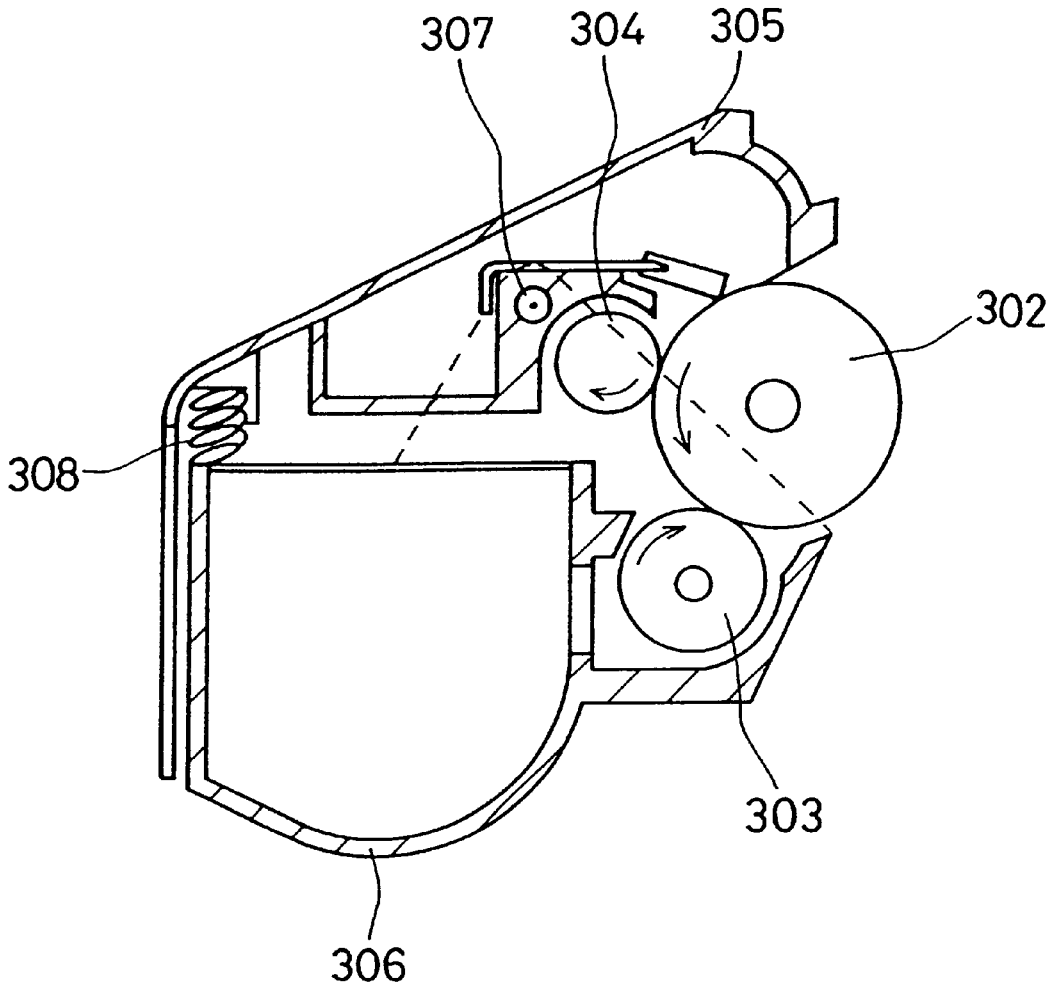
FIG. 15 (PRIOR ART)
FIG. 15 is an outside perspective view showing another conventional image forming unit.

The following is a description of a driving principle of stably driving the photosensitive member 30 and the developing roller 31 with reference to FIG. 13.

FIG. 13 is a view to explain how the photosensitive member 30 and the developing roller 31 are driven in one embodiment according to the present invention.

In FIG. 13, numeral 96 denotes a developing roller gear, 94 denotes a rocking gear, 62 denotes a developing driving main body gear, and 20R denotes a portion protruding towards the inside of the right side wall of the carriage 2. Numeral 90 denotes a supporting pin connecting the developing unit 35 and the photosensitive member unit 37, and 91 denotes a circular protruding portion provided at the right side wall 37R of the photosensitive member unit 37. The circular protruding portion 91 and the rocking gear 94 enter a cutout 29 of the right side wall 20R of the carriage 2. The rocking gear 94 meshes with the developing driving main body gear 62. Therefore, when the image forming unit 3 swings with the photosensitive member 30 as a center, the circular protruding portion 91 is in contact with the side face 27 of the cutout 29.

In the configuration mentioned above, when the photosensitive member 30 is coupled to the output axis 70 and the detent axis 81 to be positioned at the regular position and the developing driving main body gear 62 is rotated, the image forming unit 3 is supported at the both ends of central axis of the photosensitive member 30 from the apparatus main body 1. In this state, when the photosensitive member 30 and developing driving main body gear 62 are rotated, the image forming unit 3 is subjected to counterclockwise rotation moment with a central axis of the supported photosensitive member 30 as a center. This rotation moment can be stopped when the circular protruding portion 91 is in contact with the side face 27 of the cutout 29 of the carriage side wall 20R. That is, when the image forming unit 3 performs an image forming operation at the image forming position 10, the image forming unit 3 is supported at three points, i.e. at both ends of the central axis of the photosensitive member 30, and at the circular protruding portion 91 of the right side wall 37R of the photosensitive member unit 37, from the apparatus main body 1. Therefore, it is possible to perform a secure positioning of the photosensitive member 30 with respect to the apparatus main body 1. And at the same time, the image forming unit 3 is twisted due to the developing driving force, thus solving the problem that it is difficult to bring the photosensitive member 30 into contact with the developing roller 31 reliably. Furthermore, since the circular protruding portion 91 is provided at the right side wall 37R of the photosensitive member unit 37 and the rotation power of the entire image forming unit 3 is supported only by the photosensitive member unit 37, the contact condition between the photosensitive member 30 and the developing roller 31 is not affected.

Furthermore, the rocking gear 94 and the developing main body gear 62 are meshed with each other at approximately the center of the supporting pin 90 that is a rotation supporting point of the developing unit 35 with respect to a photosensitive member unit 37. Therefore, the developing unit 35 is provided with a force by the developing driving main body gear 62 in the direction illustrated by the arrow P, which is a direction of the pressure angle of both gears. However, this force does not generate the rotation moment, with respect to the photosensitive member unit 37, with the supporting pin 90 of the developing unit 35 as a center. Further, the pressing power of the developing roller 31 and the photosensitive member 30 is not generated due to the driving force by which the developing roller 31 is driven from the apparatus main body 1.

According to the above-mentioned configuration, the pressing force of the developing roller 31 to the photosensitive member 30 is only the initially setting spring force Q (pressing force by the compression spring 102) and a tension force of the tension coil spring 110 provided at the left side wall 37L of the photosensitive member unit 37, even when the developing roller 31 is rotating. Therefore, it is possible to bring the photosensitive member 30 into contact with the developing roller 31 with a small force stably. Moreover, even if the direction of force applied from the developing driving main body gear 62 to the developing unit 35 is somewhat changed because the meshing between the rocking gear 94 and the developing driving main body gear 62 is changed, the pressing force between the developing roller 31 and the photosensitive member 30 is not changed. In particular, like in a one-component developing process, if it is necessary to bring the developing roller into contact with photosensitive member uniformly and all over the surface of the photosensitive member with weakest possible force, the present invention is effective in realizing an apparatus with a simple structure and inexpensive and high performance apparatus.

Furthermore, the photosensitive member unit 37 receives the rotation moment around the photosensitive member 30 (the rotation moment of the photosensitive member 30 and the moment due to the force, illustrated by the arrow P, applied from the developing driving main body gear 62) applied to the image forming unit 3 from the apparatus main body 1 at the side face 27 of the cutout 29 of the carriage 2. Therefore, there is no problem that the developing unit 35 is pressed by the carriage 2 to change the pressing power of the developing roller 31 with respect to the photosensitive member 30. Furthermore, similarly, since the rotation moment around the photosensitive member 30, which is applied from the outside, is applied at substantially the same position as the position in which the force is applied from the outside (at the outer periphery of the circular protruding portion 91), the repulsive force is not applied to the surface of the right and left taper holes 48R and 48L of the photosensitive member 30, which are positioned at the predetermined position. Accordingly, the precise positioning of the photosensitive member 30 is not inhibited.

Next, the following is a description of the image forming process by using the image forming apparatus having the above-mentioned structure.

When the transfer belt unit 5 and image forming units 3 for all colors are installed in their predetermined locations, the power for the apparatus main body 1 is turned on, and the fixing device 15 is heated up, while the polygon mirror 6A of the laser exposing device 6 starts to be rotated, thus completing the preparations. Moreover, right after the power is turned on, the initialization mode is operated for adjusting the state of the photosensitive member 30 and the intermediate transfer belt 50.

After these preparations are completed, first, an image formation by the image forming unit 3Y for yellow is positioned at the image forming position 10. Then, the photosensitive member 30 for yellow starts to be rotated at the image forming position 10, and at the same time, the developing roller 31, a corona charger 34 and an intermediate transfer belt 50 start to move. The driving pulley 55A is driven from the apparatus main body 1, and friction forces rotate the intermediate transfer belt 50 in the arrow direction. Herein, a peripheral speed of the photosensitive member 30 and that of the intermediate transfer belt 50 are set to be substantially the same. Furthermore, at this time, the secondary transfer roller 9 and the cleaner 51 are separated from the intermediate transfer belt 50.

In accordance with the timing with which a portion that is negatively charged homogeneously by the corona charger 34 on the surface of the photosensitive member 30, a detection means (not shown) detects the top position of the intermediate transfer belt 5. In synchronization with this detected signal, the photosensitive member 30 is irradiated with a pixel laser signal beam 8 from the laser exposing device 6, forming the electrostatic latent image on the photosensitive member 30. The thus formed latent images sequentially are developed by the developing unit 35 so as to form into toner images. Next, the toner images formed on the photosensitive member 30 are moved toward the primary transfer position while being in contact with the intermediate transfer belt 50, and transcribed sequentially on the intermediate transfer belt 50. The yellow image forming operation is completed after the end of the image is transferred onto the intermediate transfer belt 50, and the photosensitive member 30 and the intermediate transfer belt 50 stop at the initial position.

Moreover, at the time of image formation, the photosensitive member 30 is charged to −450V by the corona charger 34. The exposure potential of the photosensitive member 30 becomes −50V. Furthermore, a DC voltage of −250V is applied to the developing roller 31. Furthermore, a DC voltage of −1.0 kV is applied to the guide pulley 55C and the tension pulley 55D of the intermediate transfer belt 50.

Yellow image forming is completed and the operation of the photosensitive member 30 and the intermediate transfer belt 50 stops, the engagement between the yellow photosensitive member 30 and the driving source of the apparatus main body 1 is released, and then the carriage 2 rotates 90° in the arrow direction. This moves the yellow image forming unit 3Y away from the image forming position 10, and the next, magenta image forming unit 3M is positioned and stops in the image forming position 10. When the magenta image forming unit 3M stops in the image forming position 10, the driving source of the apparatus main body 1 engages the photosensitive member 30, and the image forming unit 3M and the transfer belt unit 5 start to operate, and an image forming operation is performed, similarly as for yellow. Thus, a magenta toner image is formed overlapping a yellow toner image on the intermediate transfer belt 50.

Thus, sequential switching operations and image forming operations are repeated for cyan and black, so that four toner images are formed on the intermediate transfer belt 50.

When the top of the black toner image, transferred by primary transfer, comes to the position of the secondary transfer roller 9, the secondary transfer roller 9 is moved. Then, recording paper, which is fed from the paper feed unit 12, is sandwiched and conveyed between the secondary transfer roller 9 and the intermediate transfer belt 50, and the four-color toner image is transferred in one batch onto the recording paper. During this time, a voltage of +800V is applied to the secondary transfer roller 9. The toner image transferred onto the recording paper is fixed on the recording paper by passing a fixing device 15, and is ejected out of the apparatus with the paper eject rollers 18.

Any toner remaining on the intermediate transfer belt 50 is scraped off by the cleaning blade 53 that is brought into contact with the intermediate transfer belt 50. A screw 52 collects the scraped-off toner into the waste toner case 57.

When the secondary transfer is finished, the intermediate transfer belt 50 and the image forming unit 3 stop again, and the carriage 2 rotates 90°. Then, the yellow image forming unit 3Y reaches the image forming position 10, thus completing the preparations for the color image forming operation of the next color.

In the above-mentioned embodiment, the driving force of the developing unit 35 is applied directly from the apparatus main body 1, but there is no necessary limitation to this configuration. For example, driving force may be applied from the photosensitive member 30.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An image forming unit comprising a photosensitive member unit having a photosensitive member on the surface of which a electrostatic latent image is formed, and a developing unit which has a developing agent, a developing roller supporting the developing agent at the developing region, and a driving transmitting means for rotating the developing roller, and which develops the electrostatic latent image to be a manifest image, wherein the developing unit is supported by the photosensitive member unit rockably, and a point of application of a driving force applied to the driving transmitting means from the outside of the developing unit is located substantially on the rocking center axis of the photosensitive member unit and the developing unit.

2. The image forming unit according to claim 1, wherein the developing roller is in contact with the photosensitive member, thereby developing an electrostatic latent image to be a manifest image.

3. An image forming apparatus comprising a plurality of image forming units combining a developing device and a photosensitive member for each color an image forming unit transmitting means for switching the image forming units by sequentially shifting the image forming unit for each color between an image forming position and other waiting positions; a positioning means for positioning the photosensitive member to the image forming position; an exposing means for exposing the photosensitive member located at the image forming position; a transfer means for transferring sequentially the toner images of many colors, which are formed on the photosensitive member at the image forming position by the developing device, to form a toner image in which toner images of a plurality of colors are overlapped on the photosensitive member; and a rotation driving means for driving to rotate the photosensitive member and the transfer means, wherein an image forming unit according to claim 1 is used as the image forming unit.

4. The image forming unit according to claim 1, wherein, at the image forming position, the rocking center axis of the photosensitive member unit and the developing unit is located in the vicinity of a vertical line that passes through the center of gravity of the photosensitive member unit or developing unit and at upper portion or lower portion than the center of gravity.

5. The image forming unit according to claim 1, wherein a driven gear that is driven directly from the outside of the image forming unit by the driving force transmitting means for driving the developing roller is supported rockably with the rotating axis of the developing roller as a center.

6. An image forming unit comprising a photosensitive member unit having a photosensitive member on the surface of which a electrostatic latent image is formed, and a developing unit which has a developing agent, a developing roller supporting the developing agent at the developing region, and a driving transmitting means for rotating the developing roller, and which develops the electrostatic latent image to be a manifest image, wherein the developing unit is supported by the photosensitive member unit rockably at the driving side of the developing unit, and the relative position between the photosensitive member of the photosensitive member unit and the developing roller is determined by a sliding guide provided at the photosensitive member unit at the opposite side to the driving side of the developing unit, and a point of application that transmits rotation force to the developing unit, is provided in the vicinity of the rocking center axis of the photosensitive member unit and the developing unit.

7. An image forming unit comprising a photosensitive member unit having a photosensitive member on the surface of which a electrostatic latent image is formed, and a developing unit which has a developing agent, a developing roller supporting the developing agent at the developing region, a driving transmitting means for rotating the developing roller, and which develops the electrostatic latent image to be a manifest image, a driven gear that is driven directly from the outside of the image forming unit by the driving force transmitting means for driving the developing roller is supported rockably with the rotating axis of the developing roller as a center, and a rocking member that supports the driven gear rockably, wherein the rocking member engages an anchoring portion provided at the image forming unit when the rotation force is transmitted from the outside of the image forming unit to the developing roller, wherein the developing unit is supported by the photosensitive member unit rockably, and a point of application that transmits rotation force to the developing unit, is provided in the vicinity of the rocking center axis of the photosensitive member unit and the developing unit.

8. An image forming unit comprising a photosensitive member unit having a photosensitive member on the surface of which a electrostatic latent image is formed, and anchoring portions provided at both ends of the photosensitive member and supported by the apparatus main body, a developing unit which has a developing agent, a developing roller supporting the developing agent at the developing region, and a driving transmitting means for rotating the developing roller, and which develops the electrostatic latent image to be a manifest image, and a rotation anchoring portion provided at the driving force transmitting side of the developing unit and positioning the rotation position around the rotation axis of the photosensitive member, wherein the developing unit is supported by the photosensitive member unit rockably, and a point of application that transmits rotation force to the developing unit, is provided in the vicinity of the rocking center axis of the photosensitive member unit and the developing unit.

9. The image forming unit according to claim 8, wherein the rotation anchoring portion is provided in the photosensitive unit.

10. The image forming unit according to claim 8, wherein the rotation anchoring portion is a supporting axis that supports the developing unit rockably or a receiving portion of the supporting axis.

11. An image forming unit comprising:

a photosensitive member unit having a photosensitive member on the surface of which an electrostatic latent image is formed, and a developing unit which has a developing agent, a developing roller supporting the developing agent at the developing region, and a driving transmitting means for rotating the developing roller and developing the electrostatic latent image to be a manifest image, wherein the developing unit is supported by the photosensitive member unit rockably with the rocking center axis as a center, and a rotation moment is not generated with respect to the rocking center of the driving force applied to the driving transmitting means from the outside of the developing unit.

* * * * *